US011642777B2

(12) United States Patent
Baruch et al.

(10) Patent No.: US 11,642,777 B2
(45) Date of Patent: May 9, 2023

(54) STACKING LATCH MECHANISM

(71) Applicant: The Stanley Works Israel Ltd., Rosh Ha'Ayin (IL)

(72) Inventors: Danny Baruch, Lapid (IL); Lev Adin, Rehovot (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 268 days.

(21) Appl. No.: 16/861,466

(22) Filed: Apr. 29, 2020

(65) Prior Publication Data

US 2020/0298392 A1 Sep. 24, 2020

Related U.S. Application Data

(63) Continuation-in-part of application No. 16/514,589, filed on Jul. 17, 2019, now Pat. No. 11,486,427.

(60) Provisional application No. 62/699,903, filed on Jul. 18, 2018.

(30) Foreign Application Priority Data

Jul. 18, 2019 (EP) ..... 20171175

(51) Int. Cl.
*B25H 3/02* (2006.01)

(52) U.S. Cl.
CPC ..... *B25H 3/022* (2013.01)

(58) Field of Classification Search
CPC ... B23H 3/021; F16B 5/0635; Y01T 403/608; B65D 21/0228; B65D 21/0217; B65D 21/0224; B65D 21/0219; B65D 2251/1058; B65D 43/16; B65D 25/28; B65D 25/22
USPC ..... 403/322.4; 206/503, 508, 505; 220/324
See application file for complete search history.

(56) References Cited

U.S. PATENT DOCUMENTS 2,690,921 A * 10/1954 Braun ..... B65D 45/16 292/113
4,893,724 A * 1/1990 Schiemann ..... B65D 47/088 220/815
5,011,013 A 4/1991 Meisner
5,199,592 A * 4/1993 Reiland ..... B65D 11/1833 220/817

(Continued)

FOREIGN PATENT DOCUMENTS

DE 102015013053 A1 4/2017
EP 2436492 A2 4/2012

*Primary Examiner* — Steven A. Reynolds
*Assistant Examiner* — Prince Pal
(74) *Attorney, Agent, or Firm* — Bruce S. Shapiro

(57) ABSTRACT

A latch mechanism is configured to secure two containers together and includes a housing, a latch, a main body and a primary hook. The latch is rotatably engaged to the housing and movable between a first position, wherein it can secure a second container to the housing, and a second position, wherein it cannot secure a second container to the housing. A stopper is slidably engaged to the latch and includes a locking surface and holding surface. A stopper bias biases the stopper toward an upper position such that when the latch is in its first position, the locking surface and primary hook create a negative space which receives and secures the second container to the housing, and when the latch is in its second position, the holding surface is configured to engage a second container and prevent the latch from rotating back to its first position.

20 Claims, 27 Drawing Sheets

(56) References Cited

U.S. PATENT DOCUMENTS 8,297,464 B2 * 10/2012 Grenier ..... E05B 65/52 220/314
8,567,796 B2 * 10/2013 Bar-Erez ..... B25H 3/028 280/47.26
8,944,537 B1 2/2015 Mamalang
9,193,060 B2 * 11/2015 Ben-Gigi ..... B65D 25/2867
RE47,022 E * 9/2018 Sosnovsky ..... B65D 45/22
10,870,513 B2 * 12/2020 Gonitianer ..... B65D 21/0228
11,155,382 B1 * 10/2021 Cai ..... B65D 21/0223
11,230,410 B2 * 1/2022 Brunner ..... B25H 3/02
2003/0147691 A1 * 8/2003 Ho ..... B62J 9/23 403/322.1
2006/0042897 A1 * 3/2006 Sanderson ..... E05C 3/30 190/120
2007/0222231 A1 * 9/2007 Vilkomirski ..... E05C 3/14 292/226
2009/0263187 A1 * 10/2009 Lee ..... B25C 5/1665 403/330
2010/0320108 A1 12/2010 Riedel
2011/0139666 A1 * 6/2011 Sosnovsky ..... B65D 45/22 206/508
2012/0024739 A1 * 2/2012 Fjelland ..... F16B 45/02 403/321
2012/0080432 A1 * 4/2012 Bensman ..... B65D 25/02 220/752
2014/0251998 A1 * 9/2014 Kinskey ..... E05C 19/10 292/95
2014/0319147 A1 * 10/2014 Horovitz ..... B65D 43/0202 220/845
2015/0239631 A1 * 8/2015 Kinskey ..... B65D 81/02 220/4.21
2016/0008973 A1 * 1/2016 Bensman ..... B65D 43/16 206/372
2019/0168376 A1 * 6/2019 Brocket ..... B65D 21/02
2019/0217999 A1 * 7/2019 Wood ..... B65D 81/3813
2021/0155373 A1 * 5/2021 Cai ..... B65D 21/0212
2021/0221561 A1 * 7/2021 Davidian ..... B65D 21/0224
2021/0291954 A1 * 9/2021 Antoine ..... E05C 3/048

* cited by examiner

STACKING LATCH MECHANISM

CROSS-REFERENCE TO RELATED APPLICATIONS

This application is a continuation-in-part of U.S. patent application Ser. No. 16/514,589 filed Jul. 17, 2019, which is hereby incorporated herein by reference in its entirety.

FIELD OF THE INVENTION

The present application relates to a stacking latch mechanism.

BACKGROUND OF THE INVENTION

Carpenters and handy persons often need to carry multiple containers/stackable bodies to a jobsite. These containers/stackable bodies are often latched to one another. Typical latches are manual connectors that include a swinging portion having a hook on a first body and a protruding portion suitable for engaging the hook on the second body. These manual connectors require an operator to actively move the swinging portion into engagement with the protruding portion. This manual movement may not always be convenient. It would be good to have a stacking latch mechanism that automatically secures two bodies together by simply placing one body on top of another. Such a stacking latch mechanism would secure the two bodies together without an operator needing to physically move any parts of the latch.

The present invention overcomes one or more of the drawbacks discussed above.

BRIEF SUMMARY OF THE INVENTION

The present invention relates to a latch mechanism configured to secure two bodies together by simply placing one body on top of the other and applying moderate downward pressure to the top body. Alternatively, the weight of the upper body would supply enough downward force to engage the latch mechanism and secure the two bodies together. The latch mechanism includes a housing and a latch partially disposed within the housing. The latch includes a main body, and a primary hook and an opposing secondary hook both extending from the main body. The latch is configured to be rotatable between a first position and a second position. In the first position, the primary hook is not obscured by the housing. In the second position, the primary hook is substantially obscured by the housing. The latch mechanism also includes a bias configured to bias the latch toward its first position.

In another embodiment, the housing of the latch mechanism may also be a lid of a container.

In yet another embodiment, the housing of the latch mechanism may also be a stackable body. In this embodiment, the housing may also include a step configured to be received by another latch mechanism.

In yet another embodiment, the latch mechanism may include a housing, a latch partially disposed within the housing, a main body and a primary hook configured to secure a second container to the housing. The latch may be is rotatably engaged to the housing and movable between a first position and a second position. In the first position, the primary hook is adjacent the housing and, in a position, wherein it can secure a second container to the housing. In the second position, the primary hook is distal from the housing and, in a position, wherein it cannot secure a second container to the housing. The latch mechanism also includes a latch bias configured to bias the latch toward its first position. The latch mechanism also includes a stopper slidably engaged to the latch and including a locking surface and holding surface. The stopper is movable between an upper position and a lower position. The latch mechanism also includes a stopper bias configured to bias the stopper toward its upper position such that when the latch is in its first position, the locking surface and primary hook create a negative space configured to receive and secure a second container to the housing. When stopper is in its upper position and the latch is its second position, the holding surface is configured to engage a second container and prevent the latch from rotating back to its first position.

In yet another embodiment, a container having a plurality of walls defining an interior space. The container further includes a latch mechanism having a housing and a latch. The latch is partially disposed within the housing. The latch includes a main body and a primary hook configured to secure a second container to the housing. The latch is rotatably engaged to the housing and movable between a first position and a second position. In the first position, the primary hook is adjacent the housing and, in a position, wherein it can secure a second container to the housing. In the second position, the primary hook is distal from the housing and in a position wherein it cannot secure a second container to the housing. The latch mechanism also includes a latch bias that is configured to bias the latch toward its first position. The latch mechanism also includes a stopper slidably engaged to the latch. The stopper includes a locking surface and holding surface. The stopper is movable between an upper position and a lower position. The latch mechanism also includes a stopper bias configured to bias the stopper toward its upper position such that when the latch is in its first position, the locking surface and primary hook create a negative space configured to receive and secure a second container to the housing. When stopper is in its upper position and the latch is its second position, the holding surface is configured to engage a second container and prevent the latch from rotating back to its first position.

BRIEF DESCRIPTION OF THE DRAWINGS

An embodiment of the invention will now be described by way of example with reference to the drawings in which.

DETAILED DESCRIPTION OF THE INVENTION

Figure 1:
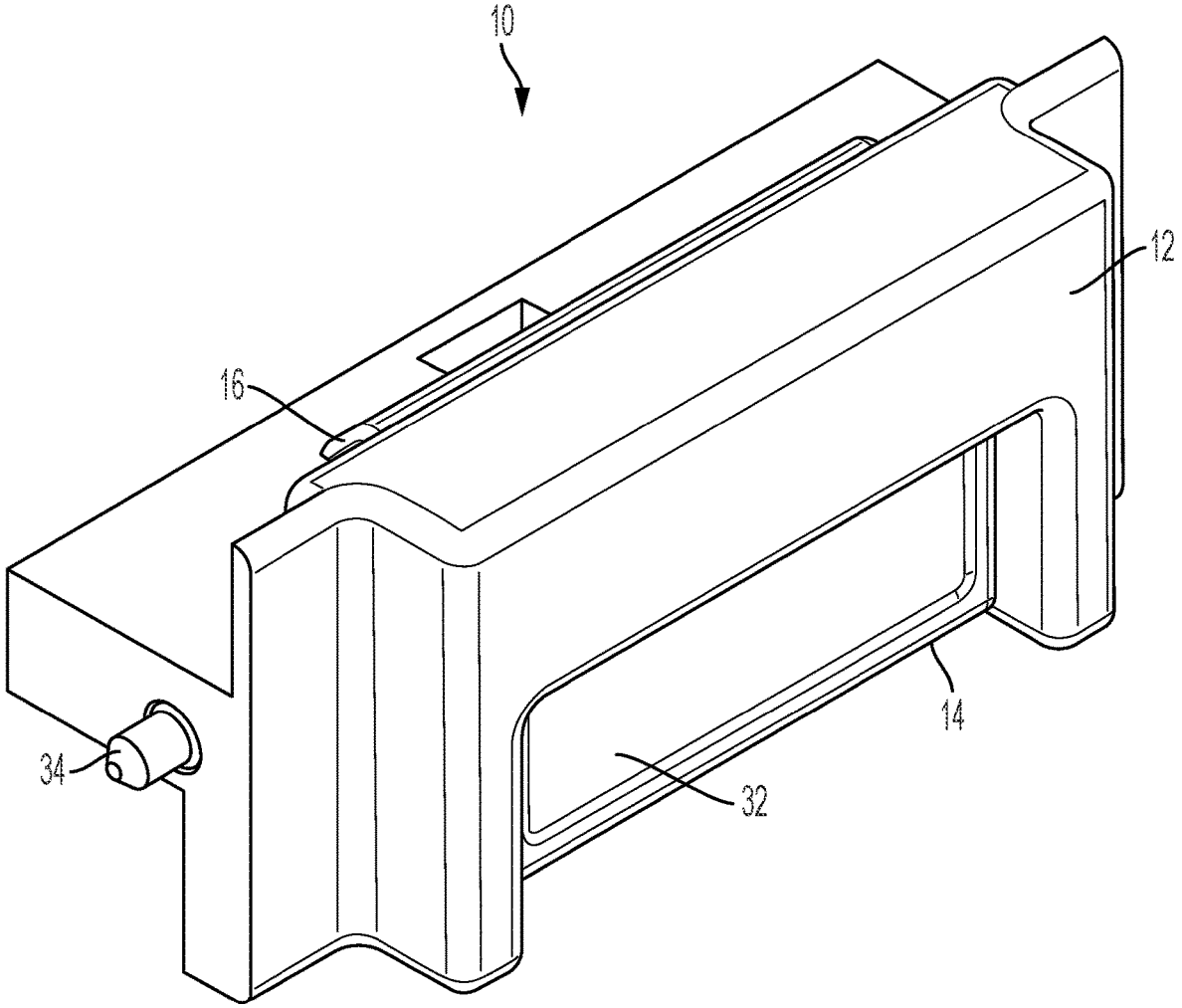
FIG. 1 is a perspective view of the front of a latch mechanism according a first embodiment of the invention.

FIG. 1 discloses an embodiment of a latch mechanism 10. Latch mechanism 10 includes a housing 12 and a latch 14. Latch 14, which may be partially disposed within the housing 12, includes a main body 15, a primary hook 16 and an opposing secondary hook 18. Latch 14 is rotatable within housing 12 between a first position and a second position. In the first position, the primary hook 16 is not obscured by the housing 12. In the second position, the primary hook is substantially obscured by the housing 12.

Latch mechanism 10 may also include one or more biases or springs 20. Bias 20, which is configured to bias the latch 14 toward its first position, may be disposed between an interior wall 22 of housing 12 and latch 14.

The primary hook 16 extends away from the main body 15 and includes a step receiving surface 24. Applying force to the step receiving surface 24 moves the latch 14 toward its second position. In a preferred embodiment, step receiving surface 24 may be angled. Primary hook 16 may further include a cantilevered surface 25. A primary tooth 26 may be positioned on the cantilevered surface 25 so as to extend downwardly and partially across the width of step receiving surface 24. Primary tooth 26 may be configured to engage a step 50 of a stackable body.

The secondary hook 18, which also extends from main body 15, may include a protruding arm 28. A secondary tooth 30 is positioned at the end of the protruding arm 28. Secondary tooth 30 extends upwardly from protruding arm 28 and has a length which is less than the length of primary tooth 26. Secondary tooth 30 is configured to engage a step 50 of a stackable body.

The main body 15 of latch 14 may also include an operator surface 32. The operator surface 32 is configured such that applying pressure thereto rotates the latch toward its second position. In a preferred embodiment, the operator surface 32 is positioned on the side of the main body 15 that is opposite the side from which the primary hook 16 and opposing secondary hook 18 extend.

Figure 3:
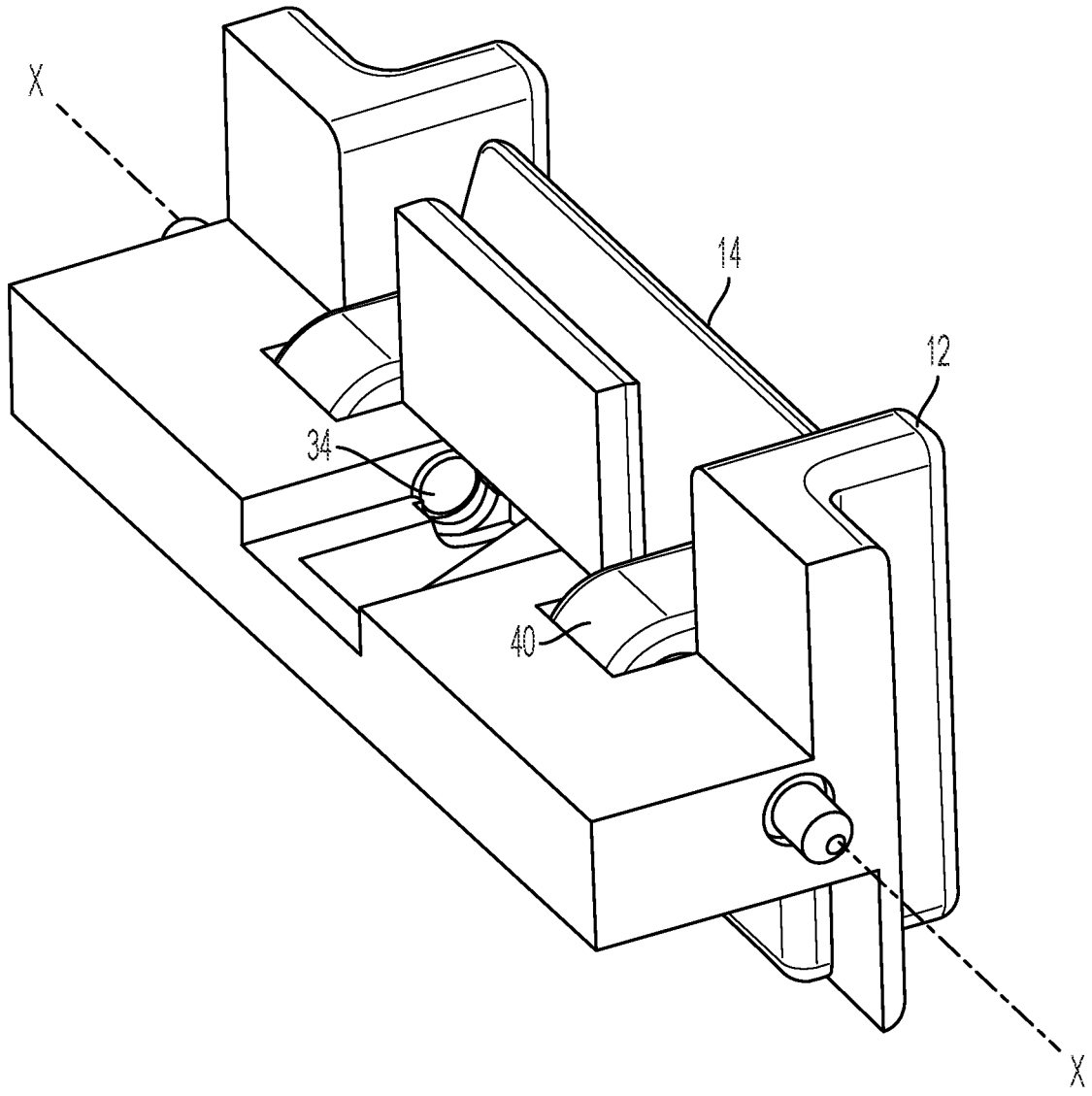
FIG. 3 is a perspective view of the bottom of latch mechanism according to the first embodiment of the invention.
Figure 4:
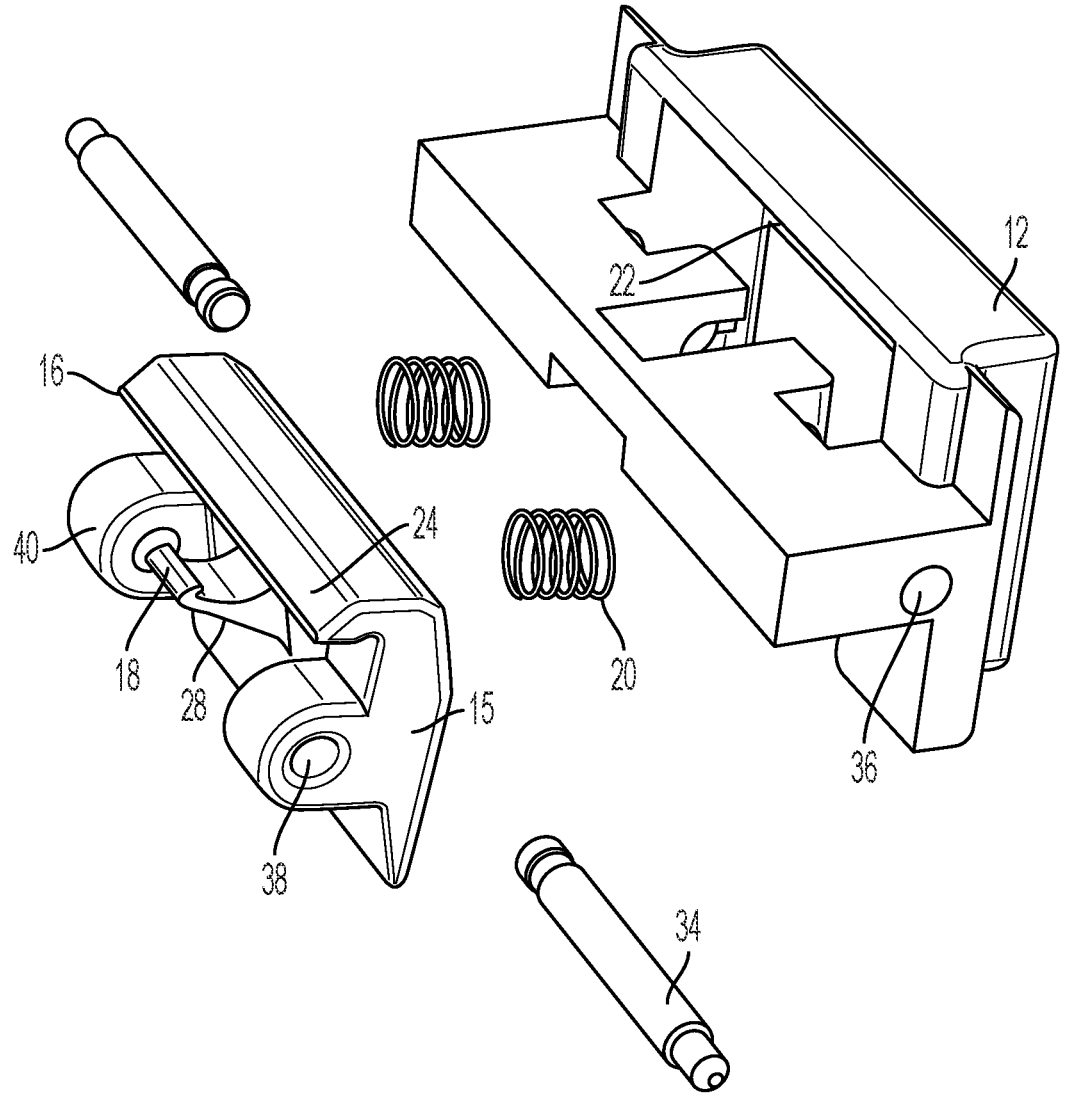
FIG. 4 is an exploded view of a latch mechanism according to the first embodiment of the invention.
Figure 5:
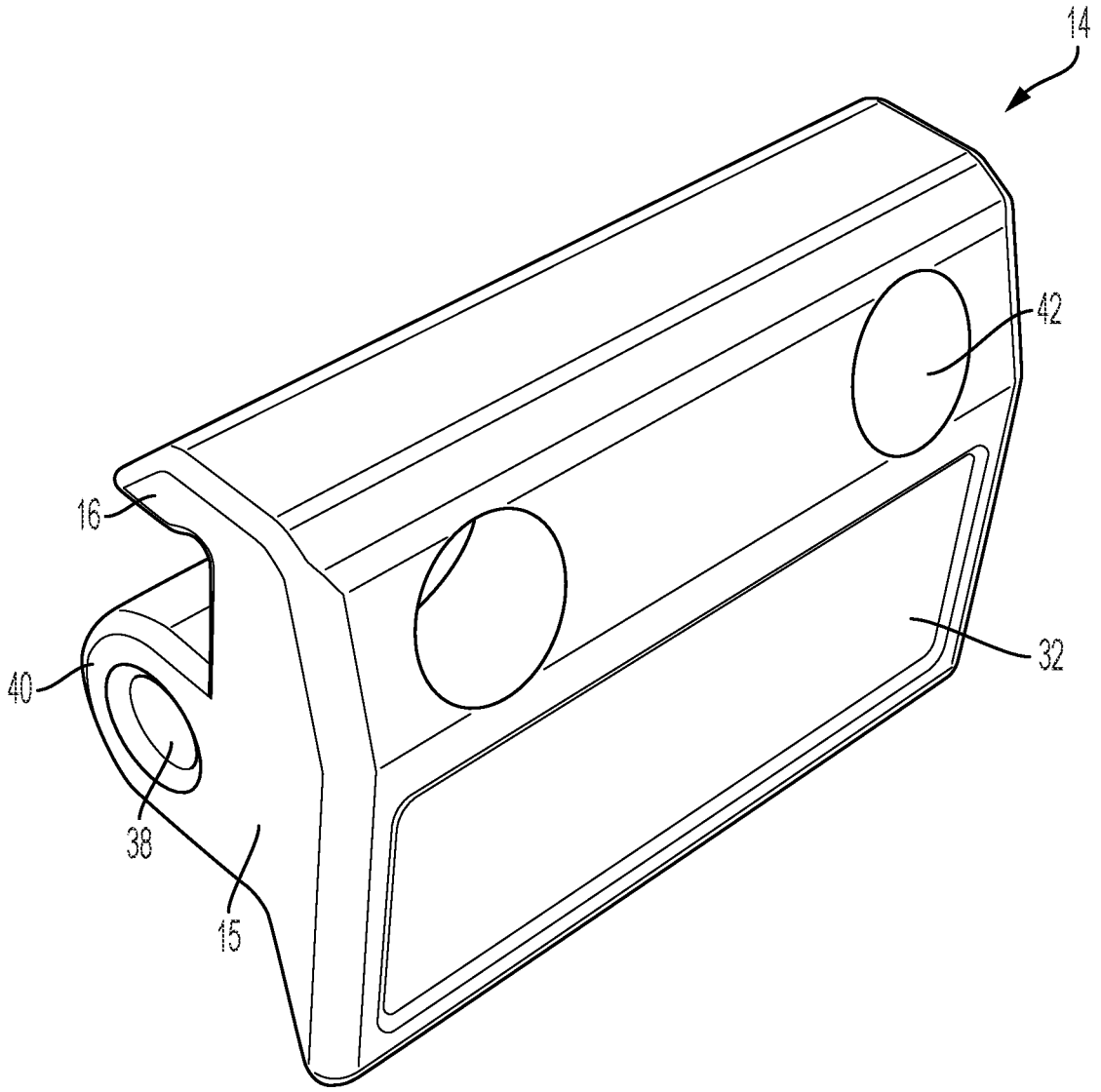
FIG. 5 is a perspective view of the front of a latch according to the invention.
Figure 6:
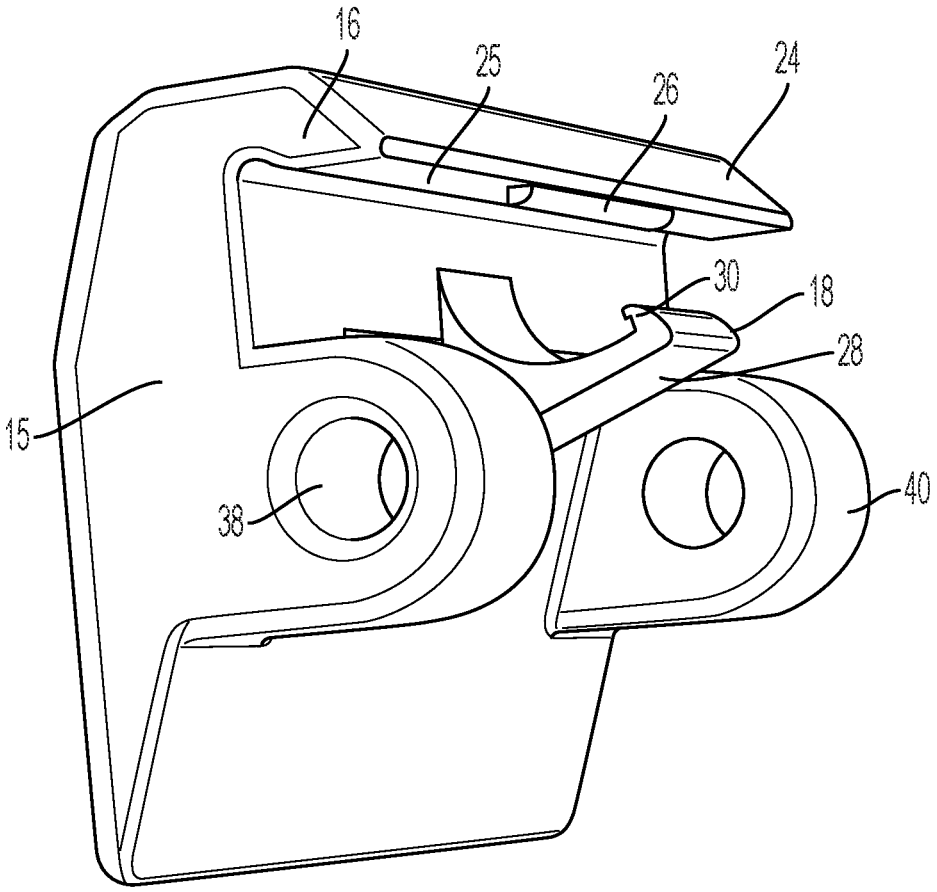
FIG. 6 is a perspective view of the rear of a latch according to the invention.

Rotational movement of the latch 14 within housing 12 may be achieved by a pin 34 simultaneously disposed in a circular through opening 36 defined in the housing 12 and an opening 38 defined in the latch 14. Those skilled in the art will recognize that the rotational movement can be improved with the use of multiple pins 34 and multiple openings 36, 38. As best seen in FIGS. 4 and 6, opening 38 may be defined in pin arms 40 that extend from the main body 15 of latch 14. In a preferred embodiment, pin arms 40 extend from the same side of the main body 15 as do primary hook 16 and secondary hook 18. As best seen in FIG. 3, when latch 14 is positioned within housing 12; pin 34, circular through opening 36 and opening 38 are all on the same axis X. One pin 34 extends through one housing opening 36 and corresponding latch opening 38. The laterally inward opening of through opening 36 includes a narrowed region against which pin 34 abuts. Alternatively, pins 34 may include channel regions and the inner ends of openings 36 may be formed with an inwardly extending collar region which may be forced into the channel regions to retain pins 34. In either case, the opposite lateral ends of pins 34 extend laterally outwardly of housing 12, and pins 34 have sufficient flexibility for slight lateral movement.

Latch 14 may also include one or depressions 42. Depressions, 42 are sized and configured to receive a bias or spring 20. When bias 20 is positioned within depression 42 and the interior wall 22 of housing 12, the entire latch 14 is biased toward its first position. In a preferred embodiment, there may be two depressions 42 and they may be positioned on the main body 15 on the same side as the operator surface 32.

Figure 2:
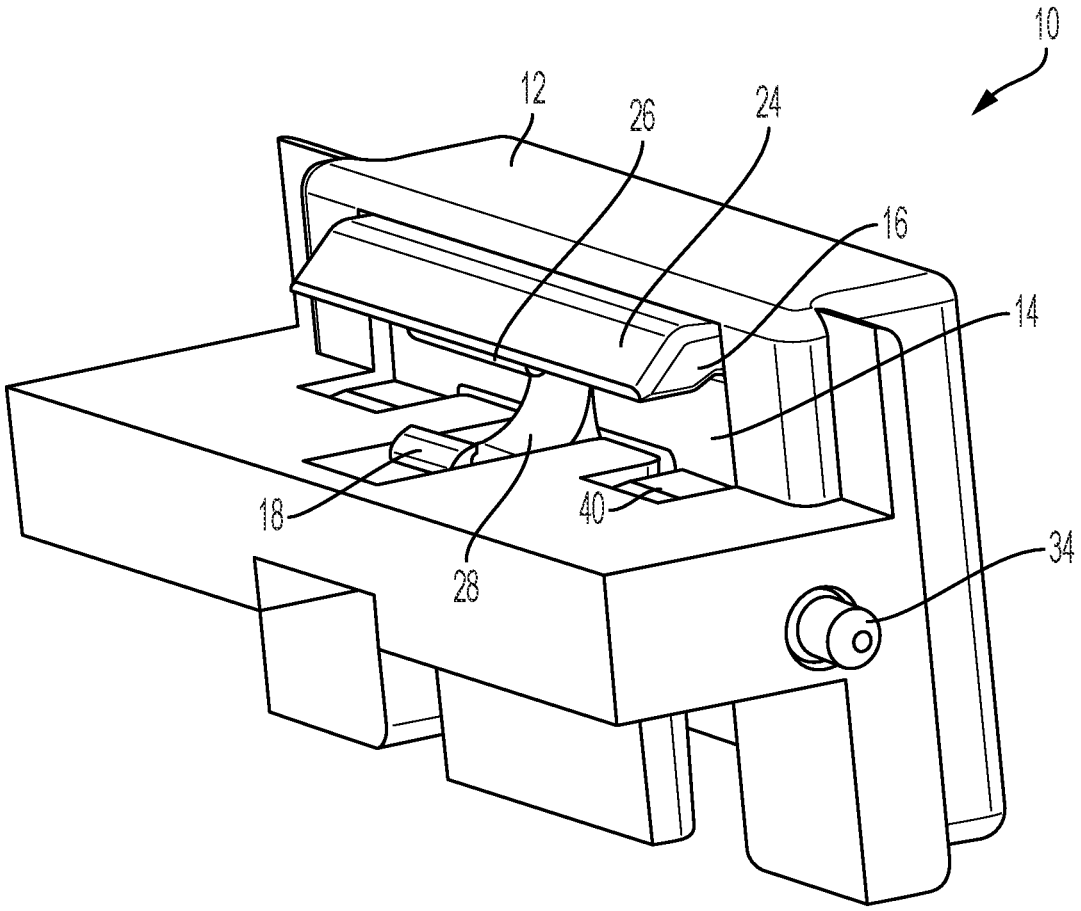
FIG. 2 is a perspective view of the rear of a latch mechanism according to the first embodiment of the invention.
Figure 12:
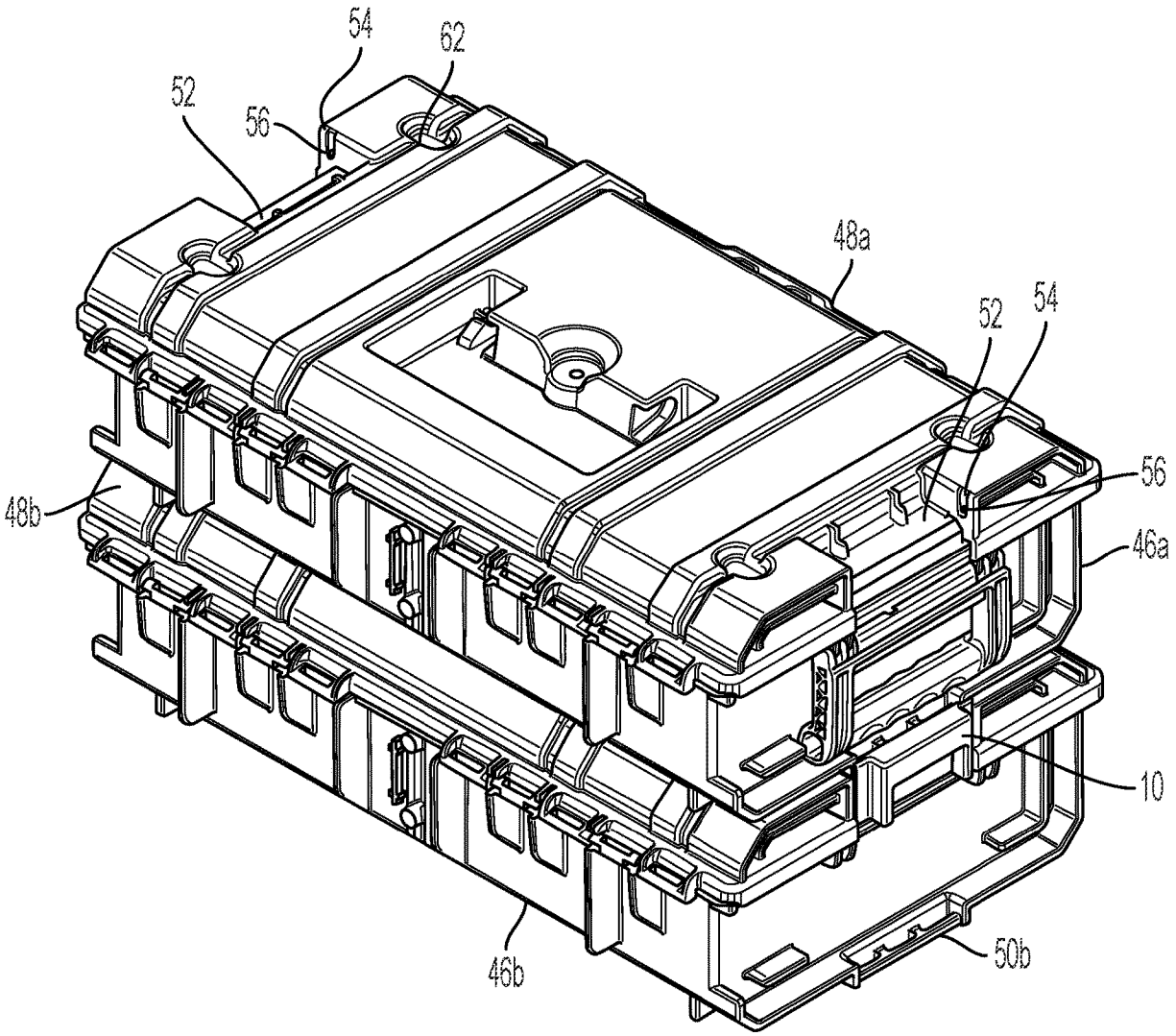
FIG. 12 is a perspective view of two containers being held together by a latch mechanism according to the first embodiment of the invention.

The latch mechanism 10 of the present invention may have a variety of different embodiments. FIGS. 1-3 show a first embodiment wherein the housing 12 is relatively compact. In this embodiment, the latch mechanism 10 may be used in conjunction with a container 44 such as that depicted in FIGS. 7 and 12. Container 44 may include a body 46 and a lid 48. Body 46 includes a step 50 that is configured to be selectively engaged and disengaged to a latch mechanism 10. Lid 48 contains one or more carveouts 52 that are configured to receive a latch mechanism 10 according to the first embodiment. As best seen in FIG. 12, carveout 52 may include one or more slots 54 and holes 56. In particular, slots 54 are formed in each side wall of carveout 52 near the laterally outermost edges thereof and extend downwardly from the top. Holes 56 are formed at the base of slots 54 and are formed as either regions of deeper indentations than the remainder of slots 54, or extend entirely through lid 48. Slots 54 and holes 56 are configured to receive pins 34. More specifically, slots 54 function as guides as latch mechanism 10 is positioned within carveout 52. Latch mechanism 10 is slid downwardly within carveout 52 with the laterally outward extending ends of pins 34 sliding in slots 54 until they reach holes 56. Pins 34 are slightly compressed inwardly while sliding in slots 54 and once latch mechanism 10 is pressed into a fully seated position, pins 34 are disposed in holes 56. When pins 34 are disposed within holes 56, the latch mechanism is secured within carveout 52.

Figure 7:
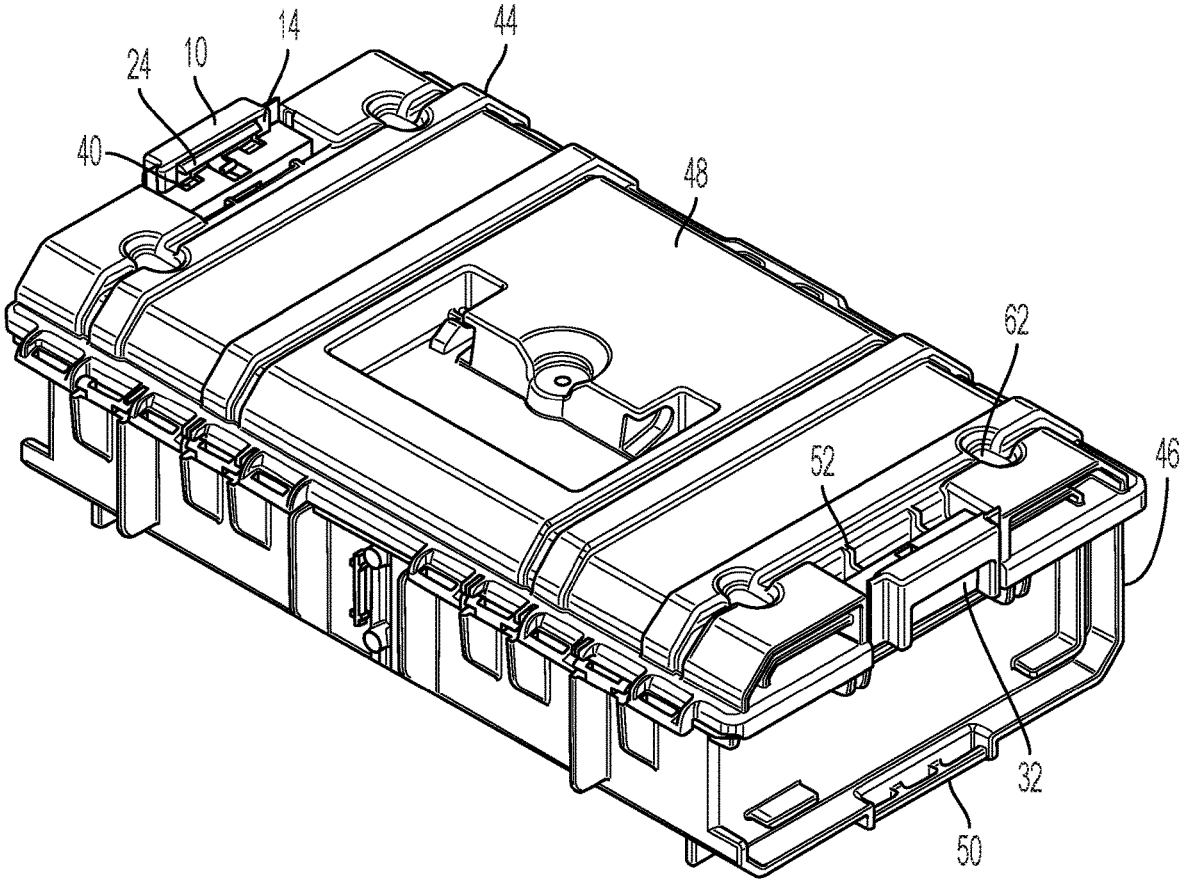
FIG. 7 is a perspective view of a container employing a latch mechanism according to the first embodiment of the invention.
Figure 9:
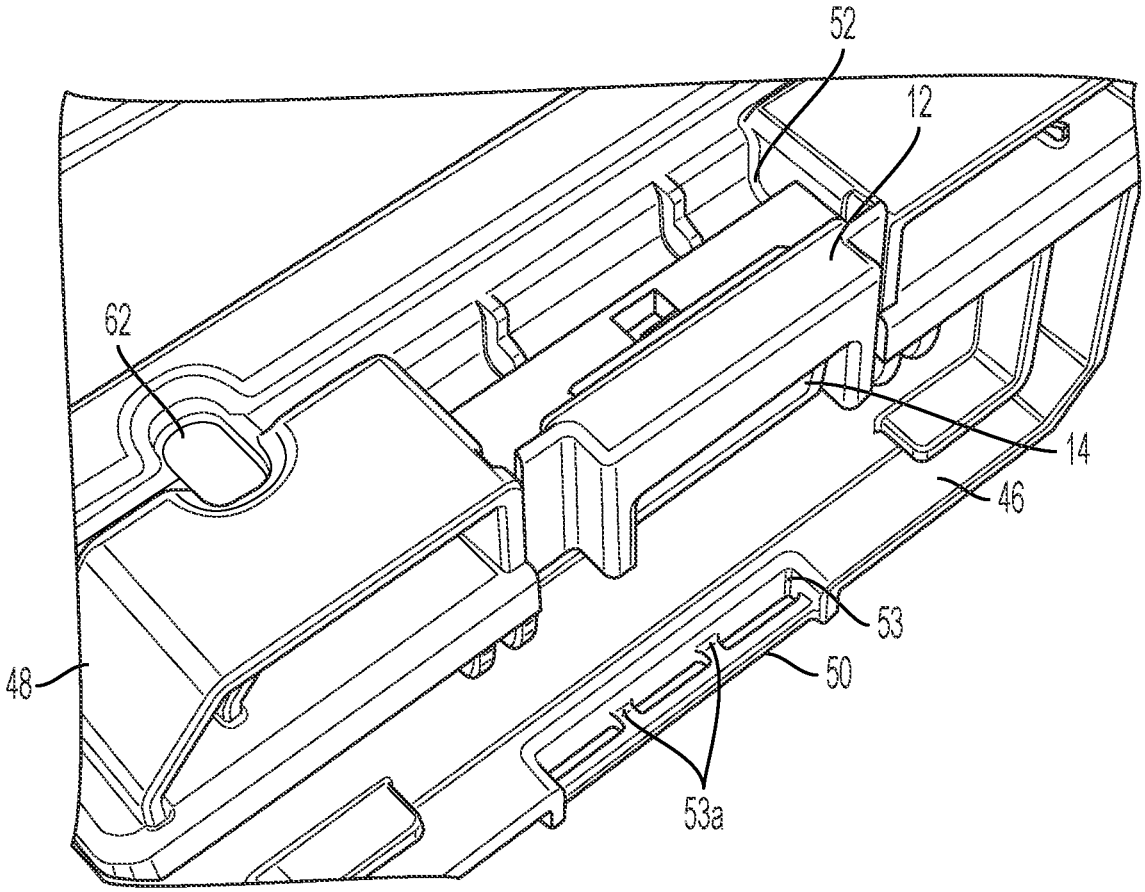
FIG. 9 is a detailed perspective view of a container employing a latch mechanism according to the first embodiment of the invention.
Figure 10:
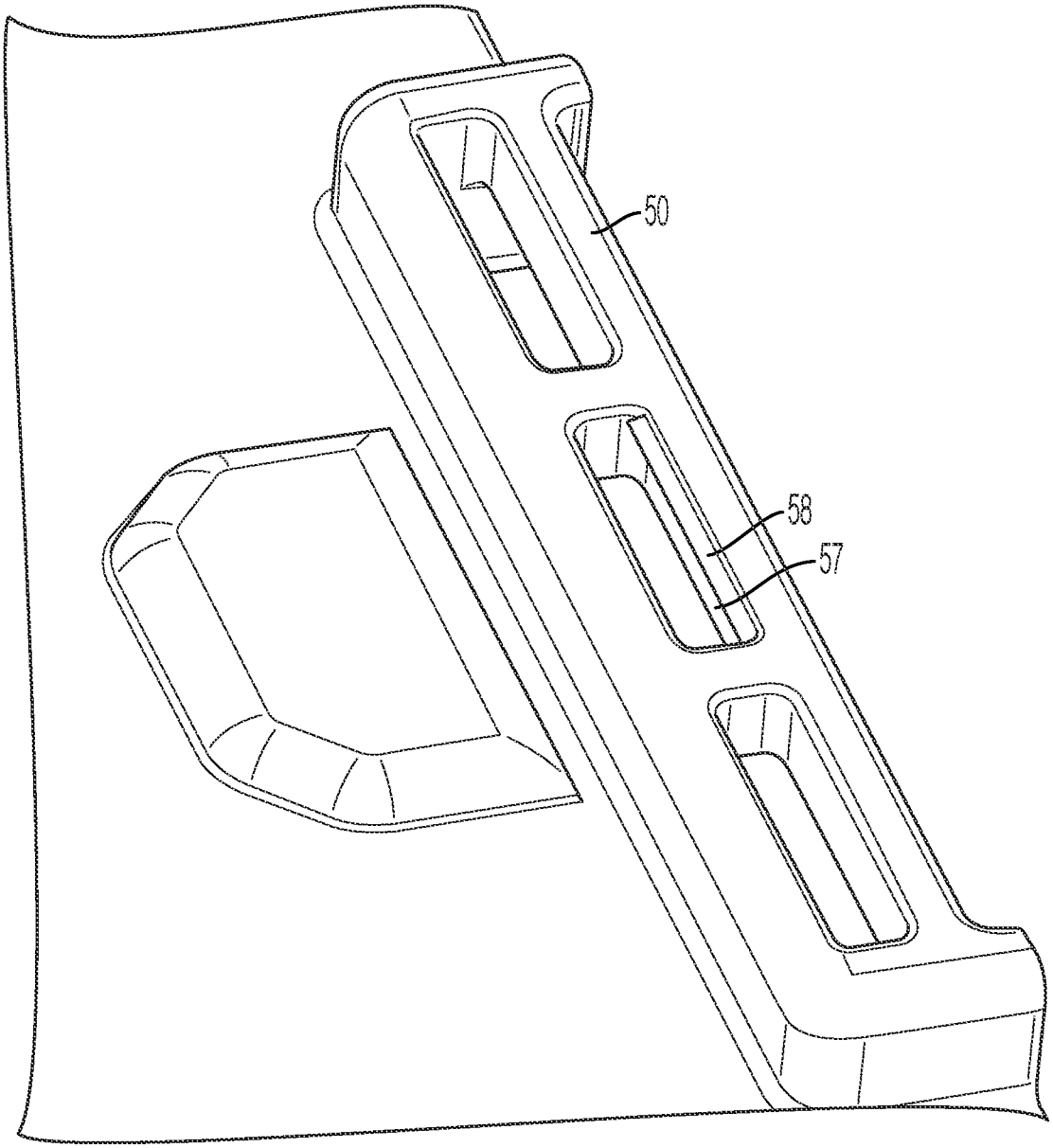
FIG. 10 is a detailed bottom perspective view of a step of a container.
Figure 11:
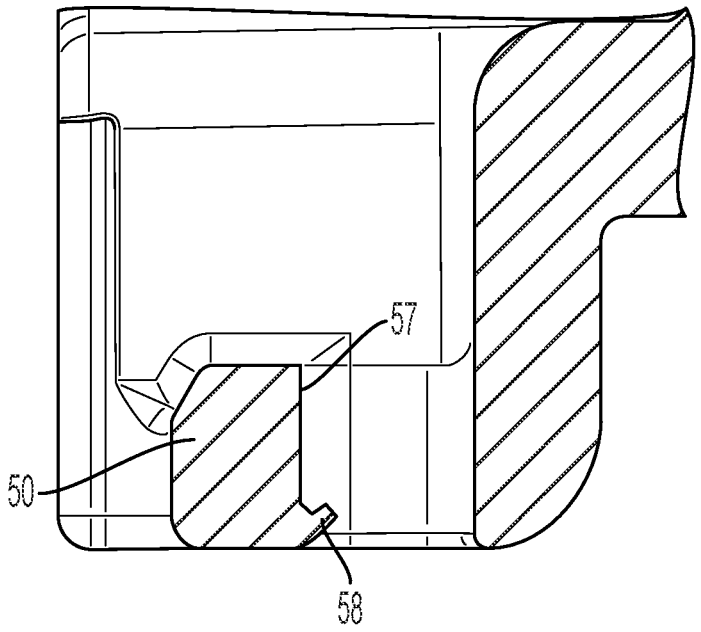
FIG. 11 is a cross sectional view of a step of a container.

Those skilled in the art will recognize that the primary function of latch mechanism 10 is to secure two bodies to one another. In order to perform this function, latch 12 is configured to selectively engage a step 50, such as that shown in FIG. 9. More specifically, the primary hook 16 and the secondary hook 18 are configured to separately engage step 50 at different locations thereof. Still further, the primary tooth 26 and the secondary tooth 30 are configured to engage step 50. Still further, the primary tooth 26 is configured to engage an upper portion 57 of step 50 and the secondary tooth 30 is configured to engage a lip 58 of step 50. With reference to FIGS. 7, 9 and 10, body 46 includes a rectangular cutout opening 53 formed on each lateral side near the bottom thereof. Body 46 includes step 50 which may have a substantially rectangular cross-sectional shape and which extends between opposite side surfaces of cutout openings 53. Step 50 may also be attached to the inner surface of cutout opening 53 via two connecting structures 53*a* to create three rectangular openings. Lip 58 is formed adjacent the lower surface of step 50 (at the top in the bottom view of FIG. 10) and extends across the middle rectangular opening. Lip 58 is located generally opposite upper portion 57.

Figure 16:
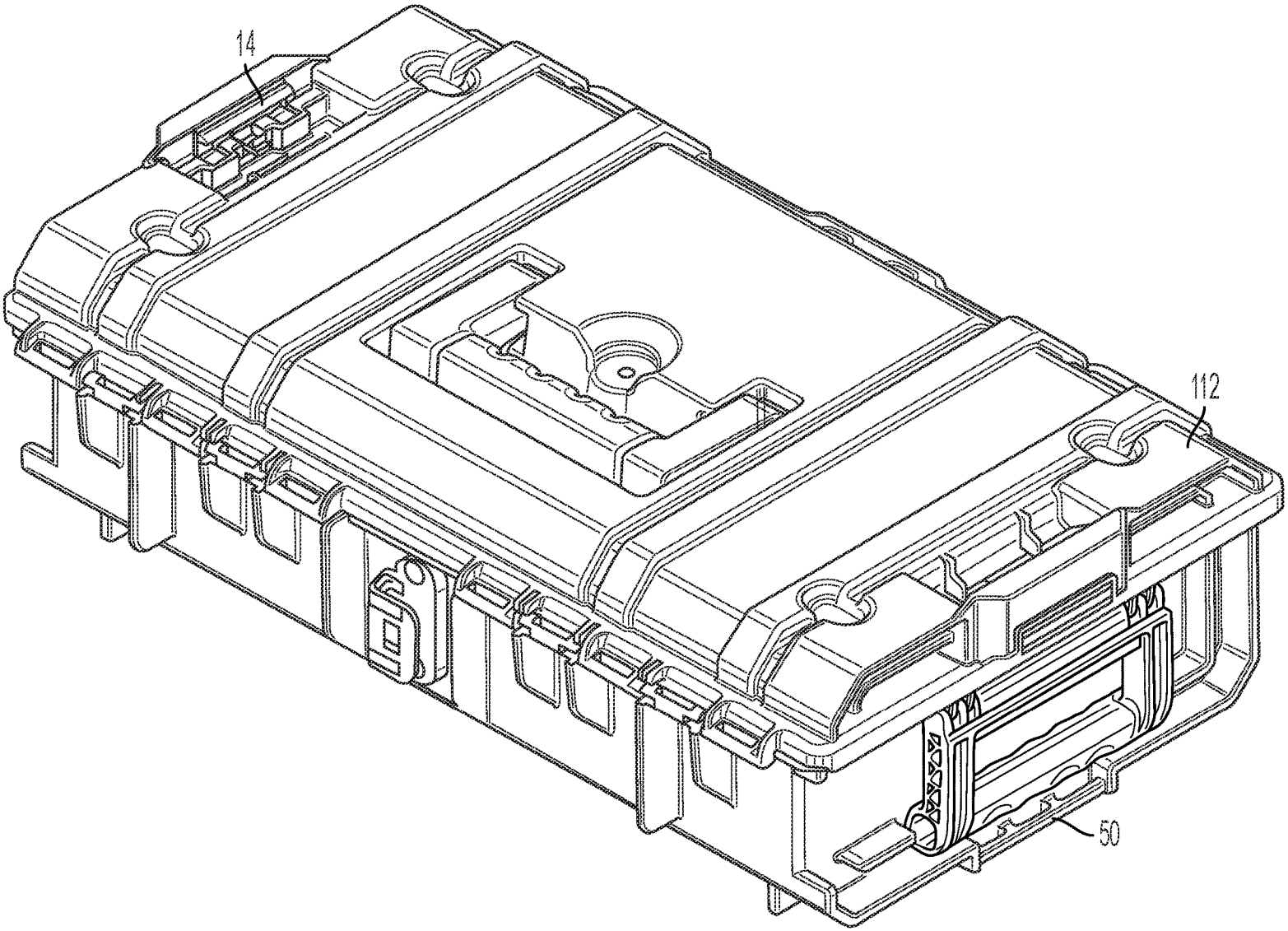
FIG. 16 is a perspective view of a latch mechanism according to a second embodiment of the invention.
Figure 17:
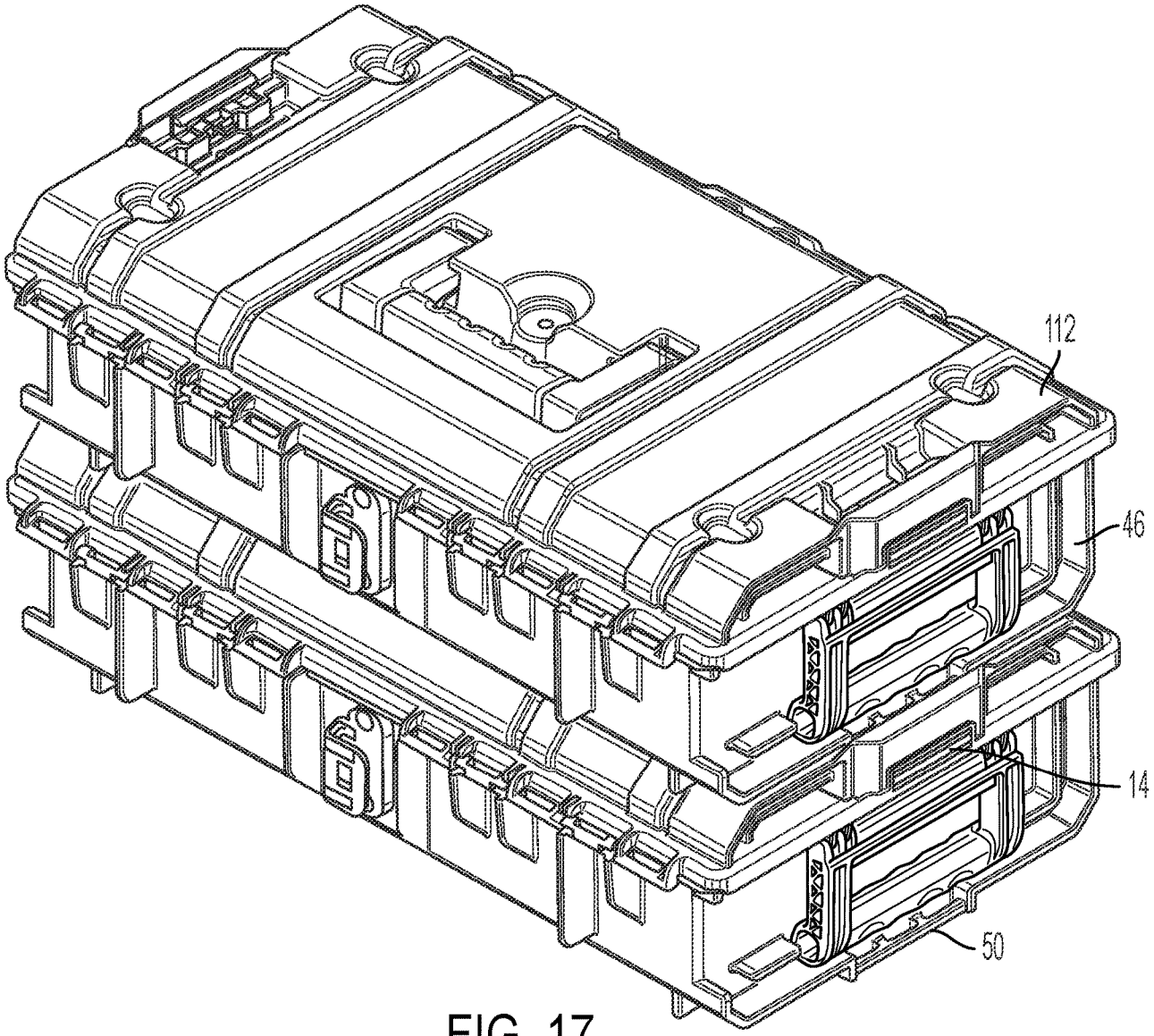
FIG. 17 is a perspective view of the latch mechanism according to the second embodiment securing two containers together.

FIG. 16 shows a second embodiment of the latch mechanism 110. This second embodiment 110 is different from the first embodiment 10 in that the housing 112 is not relatively compact. Instead, housing 112 is additionally configured to be a lid of a container. In this second embodiment, the latch 14 is identical to the latch in the first embodiment. Moreover, the latch 14 of the second embodiment also functions identically to that of the first embodiment. FIG. 17 shows the latch mechanism 110 of the second embodiment positively securing two containers together.

Figure 18:
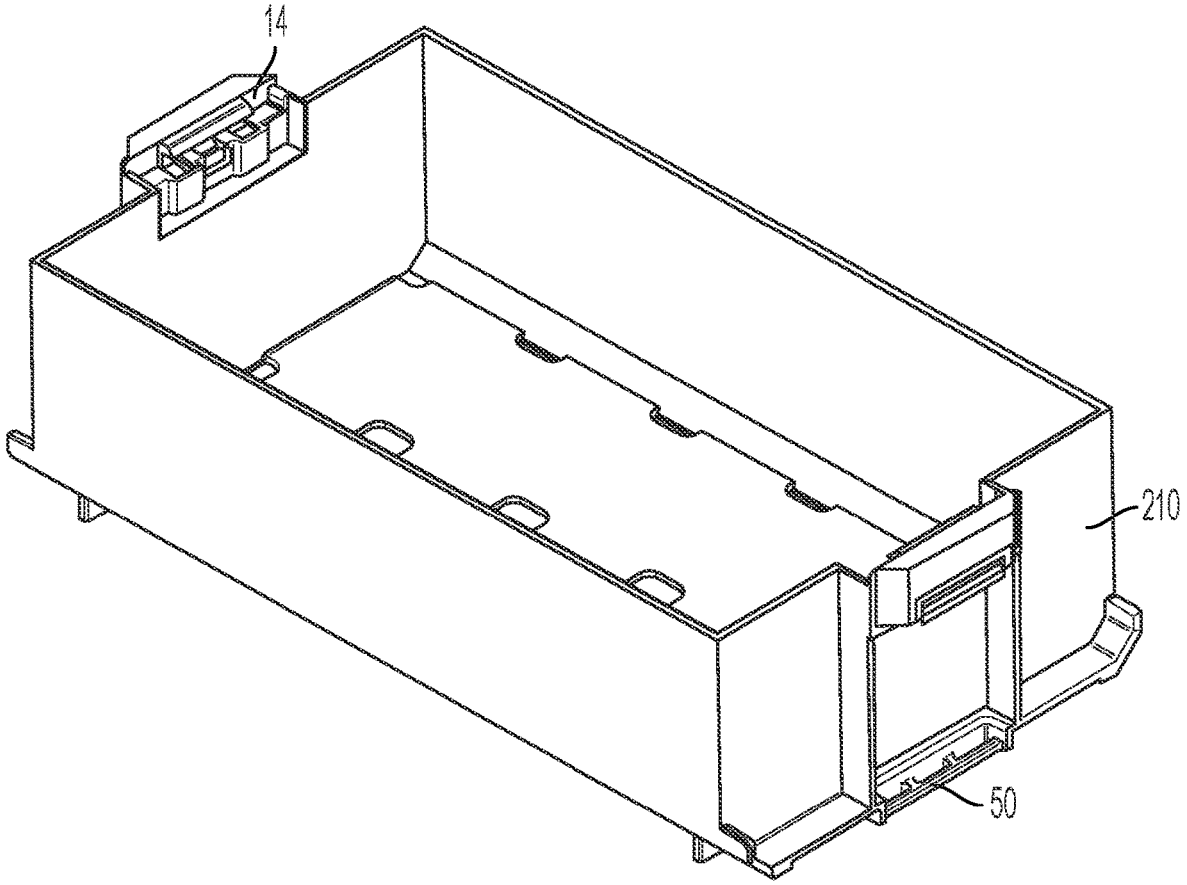
FIG. 18 is a perspective view of a latch mechanism according to a third embodiment of the invention.
Figure 19:
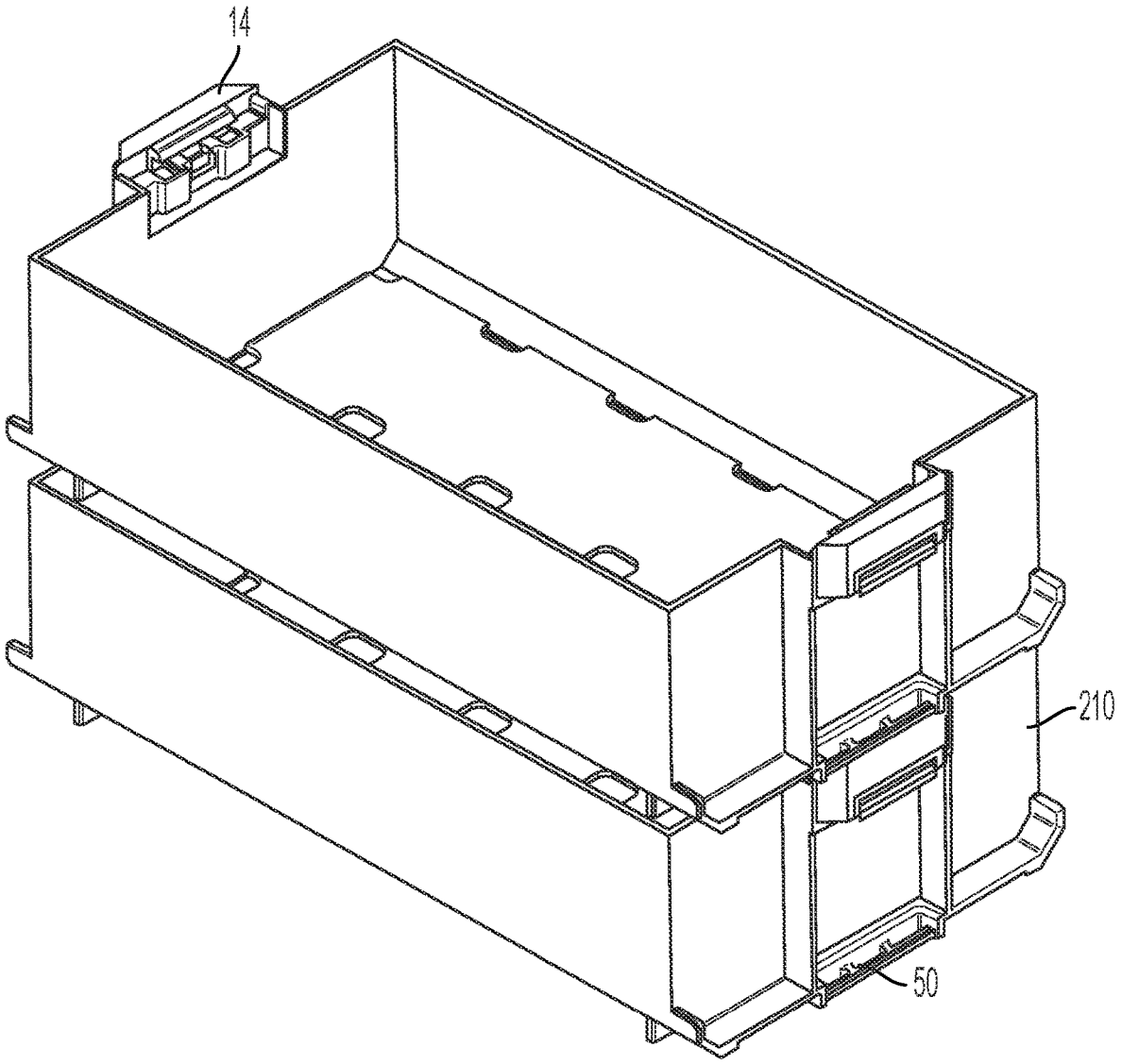
FIG. 19 is a perspective of two latch mechanisms according to the third embodiment secured together.
Figure 20:
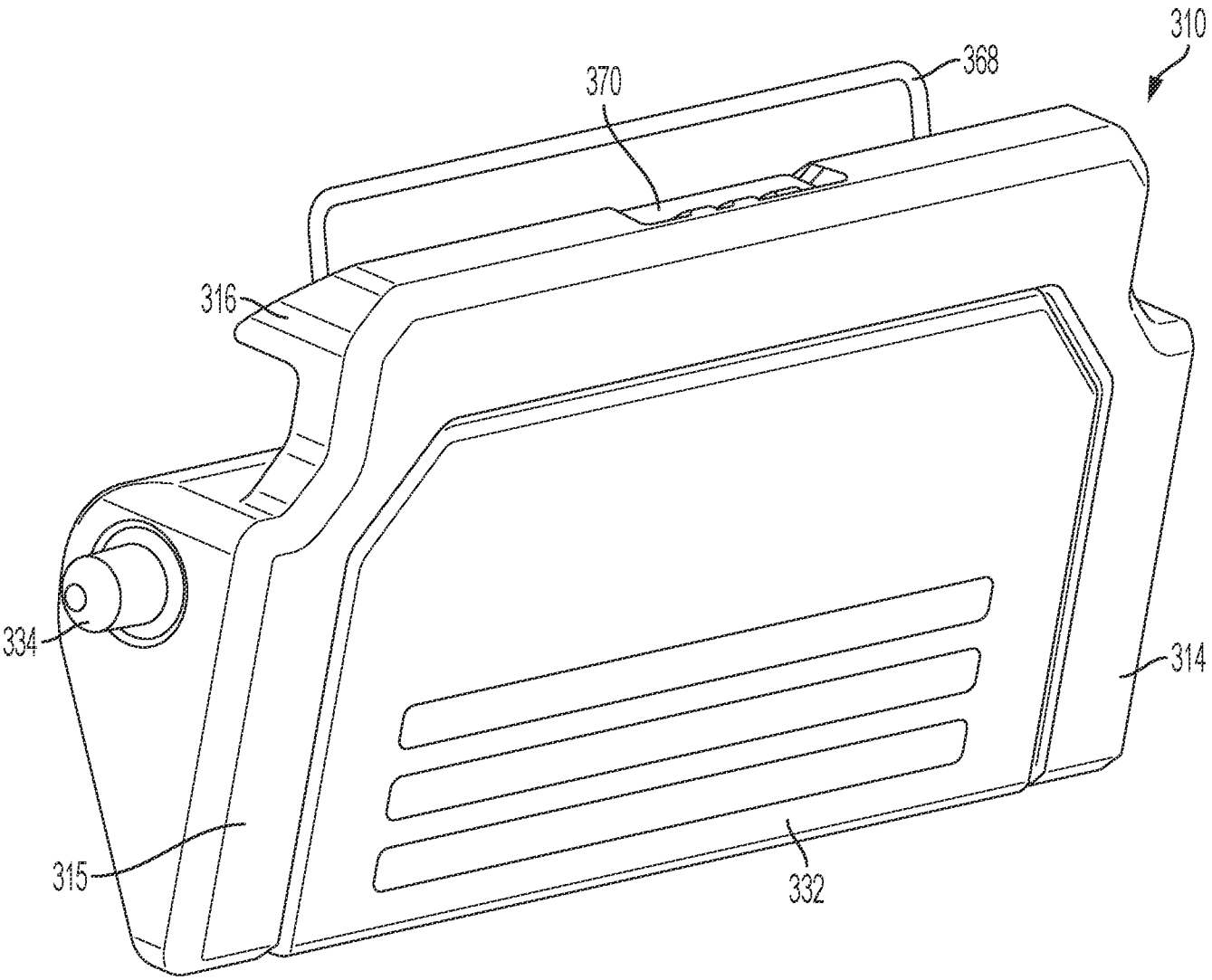
FIG. 20 is a front perspective view of a latch mechanism according to a fourth embodiment.

FIG. 18 shows yet a third embodiment from the latch mechanism 210. This third embodiment is different from the first embodiment 10 in that the housing 212 is additionally configured to be a stackable body. Housing 212 may also include a step 250 configured to be engaged by another latch mechanism. In this third embodiment, the latch 14 is identical to that of the first embodiment. Moreover, the latch 14 of the third embodiment also functions identically to that of the first embodiment. FIG. 19 shows the latch mechanism 210 of the third embodiment positively securing two stackable bodies together.

FIGS. 20-25 depict a fourth embodiment of the latch mechanism 310. As with the previous embodiments, this latch mechanism includes a latch 314 that includes a main body 315 and a primary hook 316. Latch mechanism 310 also includes a housing 312. However, as seen in FIG. 23*a*, the housing 312 also functions as the lid 348*a* or 348*b* of a container 44. Bodies 346*a* and 346*b* each include step 350*a* or 350*b*, respectively. Latch 314 is rotatably disposed in the housing 312 and movable between a first position and a second position. In the first position, the primary hook 316 is adjacent the housing 312 and positioned such that it can secure a second container to the housing 312. In the second position, the primary hook 316 is distal from the housing 312 such that it cannot secure a second container to the housing 312. In other words, when the latch is in its first position, the primary hook can limit the axial movement of a second container stacked on the housing. In the second position, the primary hook cannot limit said axial movement.

The primary hook 16 extends away from the main body 315 and includes a step receiving surface 324. Applying force to the step receiving surface 324 moves the latch 314 toward its second position. In a preferred embodiment, the step receiving surface 324 is angled. Primary hook 316 also includes a cantilevered surface 325.

Latch mechanism 310 also includes a latch bias 320. Latch bias 320 is configured to bias the latch 314 toward its first position. In a preferred embodiment, latch bias 320 may be a torsion spring including two tines 364, two coils 366, and a torsion loop 368.

Latch mechanism 310 also includes a stopper 370 that is slidably engaged to the latch 314 and includes a locking surface 372 and a holding surface 374. Stopper 370 is positioned on the same side of the latch 314 as the primary hook 316. The stopper 370 is movable between an upper and a lower position. The latch mechanism further includes a stopper bias 376 positioned between the latch 314 and the stopper 370. In a preferred embodiment, one end of stopper bias 376 may be positioned in a spring opening 380 defined by latch 314. The other end of stopper bias 376 is received by a stopper protrusion 382 of the stopper 370. Stopper bias 376 biases the stopper 370 toward its upper position. When stopper 370 is in its upper position and latch 314 is in its first position, the cantilevered surface 325 and locking surface 372 create a negative space 378 configured to receive a step 50 of a stackable body or second container and secure the same to the housing 312.

The main body of latch 314 may also include an operator surface 332. The operator surface 332 is configured such that applying pressure thereto rotates the latch 314 into its second position. In a preferred embodiment, the operator surface 332 is positioned on the side of the main body 315 that is opposite the side from which the primary hook 316 extends.

Figure 21:
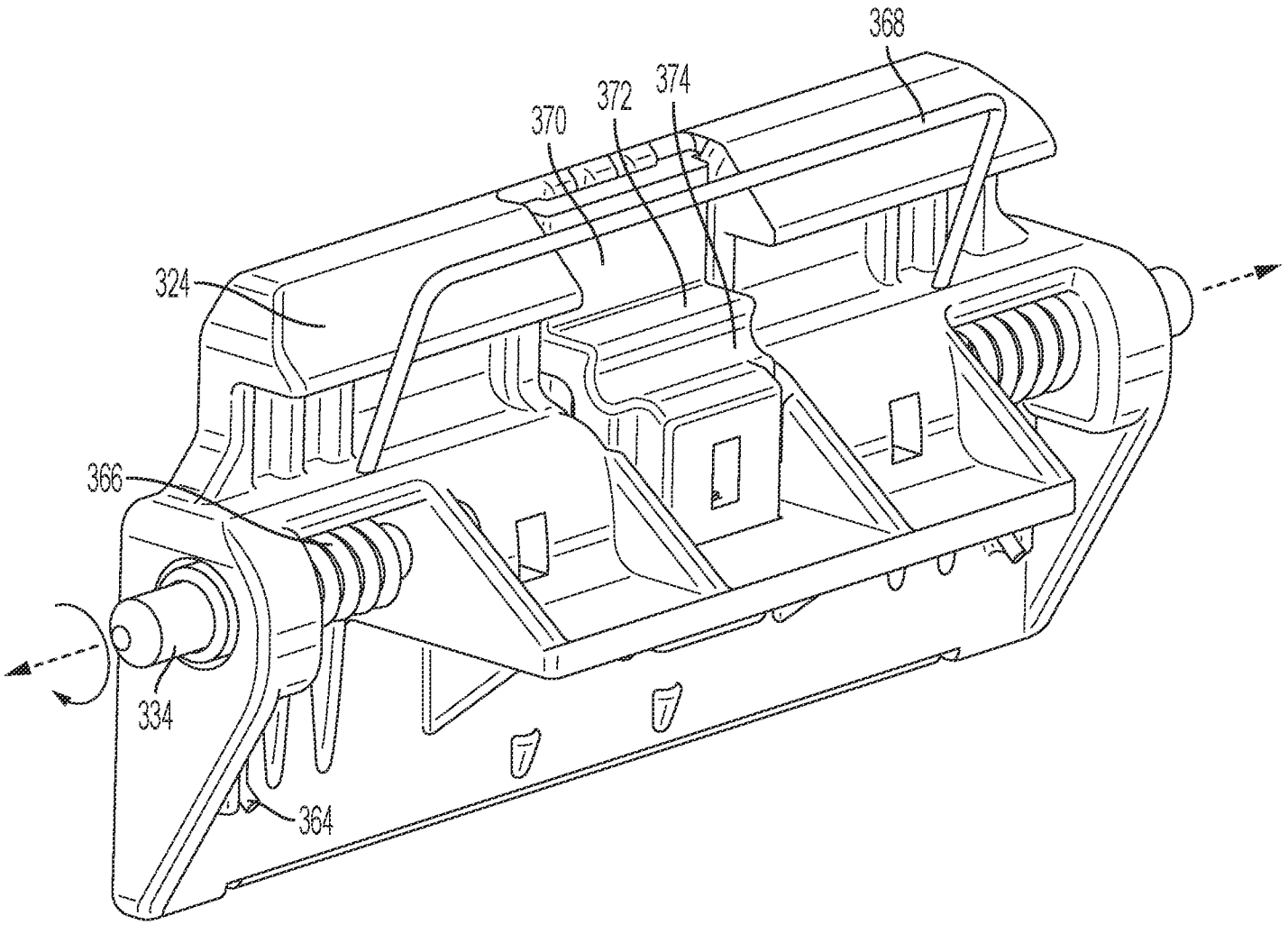
FIG. 21 is a rear perspective view of a latch mechanism according to the fourth embodiment.
Figure 22:
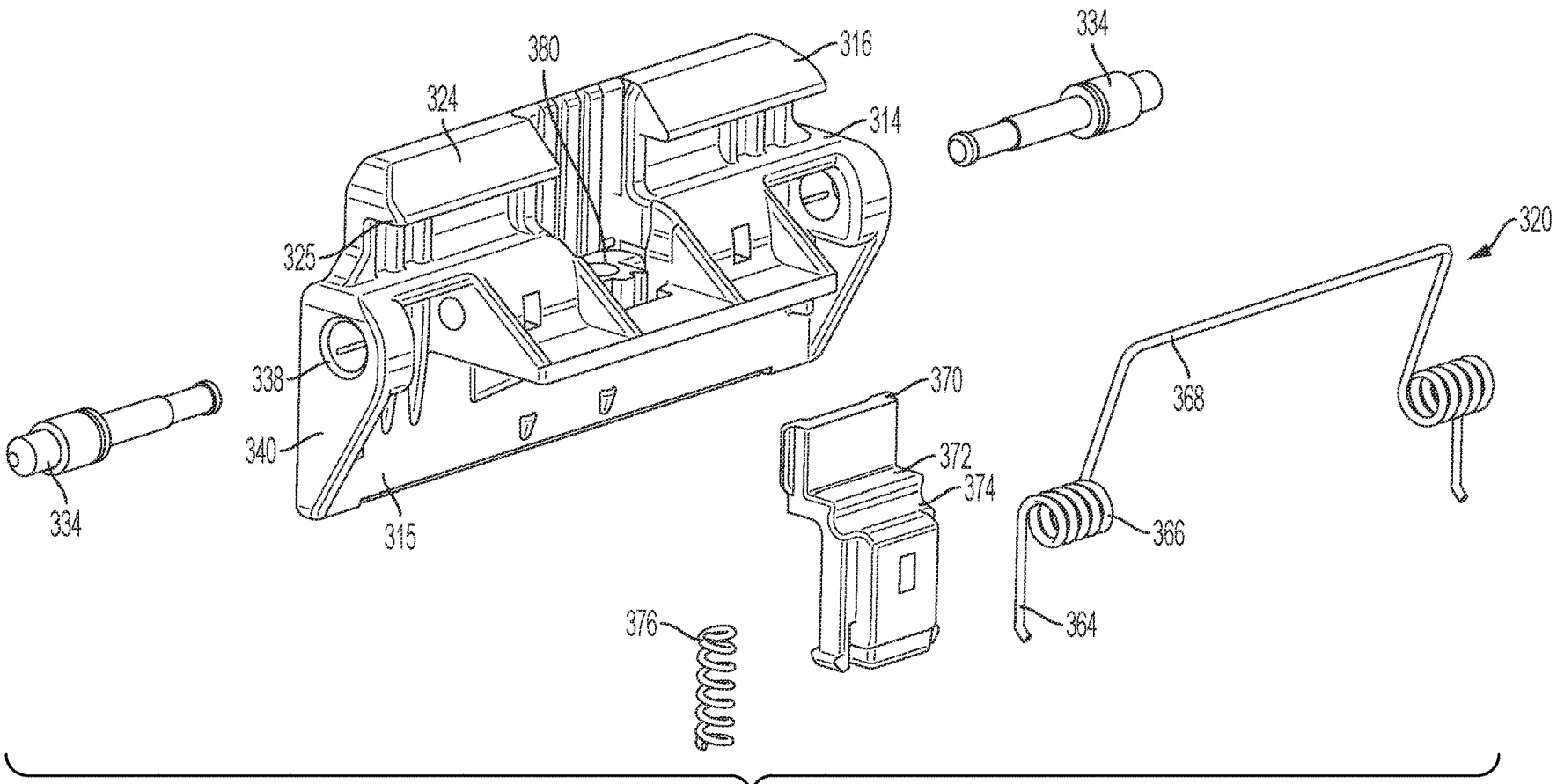
FIG. 22 is an exploded view of the latch mechanism according to the fourth embodiment.

Rotational movement of the latch is facilitated by pins 334 and the latch bias 320. Pin 334 may be simultaneously disposed in the openings 336 of the housing 312, coils 366 of the latch bias 320 and opening 338 defined by latch 314. Openings 338 may be disposed in latch arms 340, which extend from the same side of the main body 315 as does the primary hook 16. As best seen in FIG. 21, pins 334 form a rotational axis X. Tines 364 are positioned against the main body 315 on a side opposite the operator surface 332. In order to achieve the rotational bias, torsion loop 368 is rotated away from the latch 314 and positioned against the housing 312. When the torsion loop is positioned in this manner, energy is stored in the latch bias 320. The energy in the latch bias 320 applies force against the main body 315. More specifically, the tines 364 apply force is applied to the side of the main body 315 opposite the operator surface 332. This force causes the latch to rotate around the pins 334 and axis X toward the latch's first position.

Figure 23A:
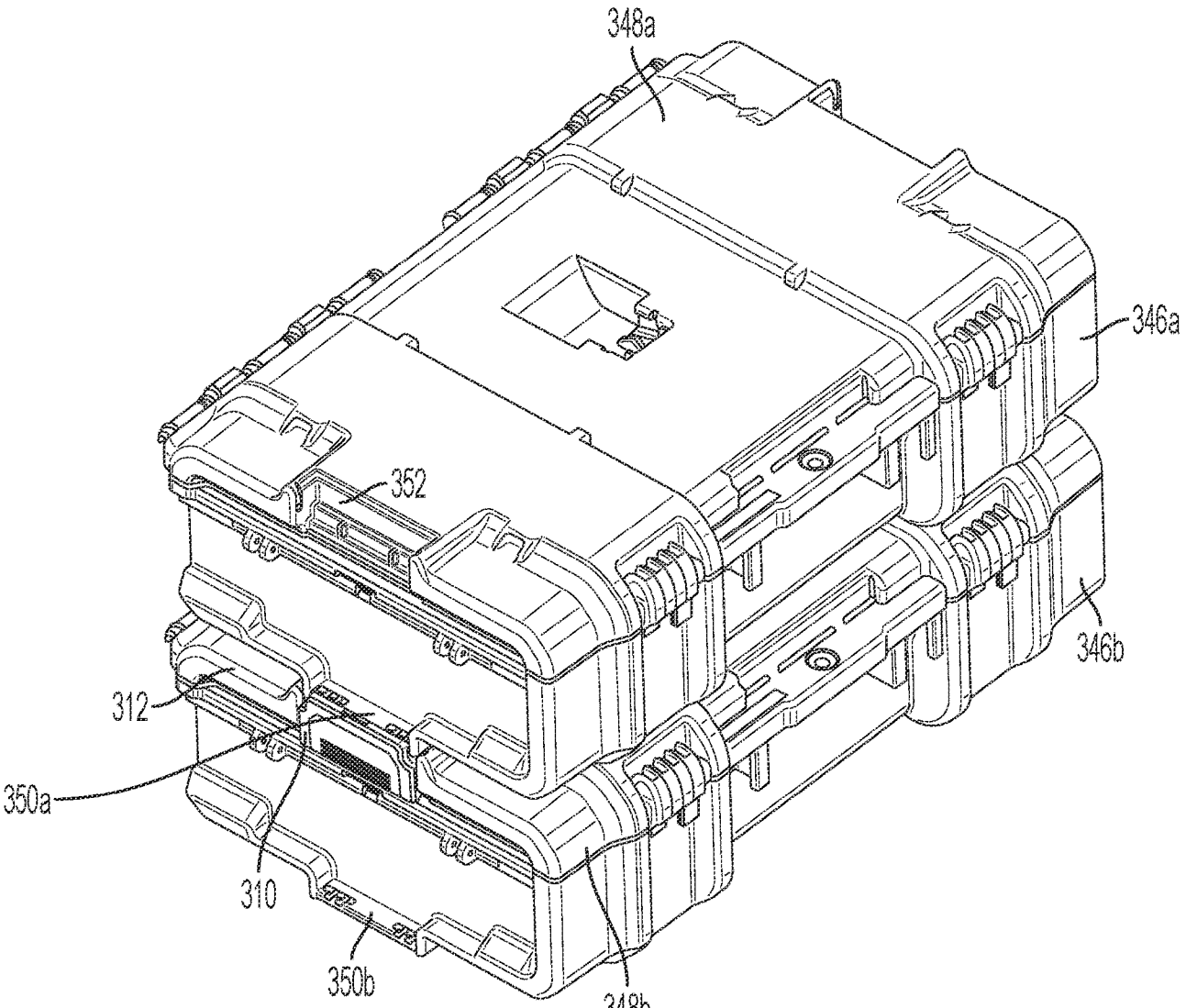
FIG. 23A is a perspective view of two containers being held together by a latch mechanism according to the fourth embodiment of the invention.
Figure 23C:
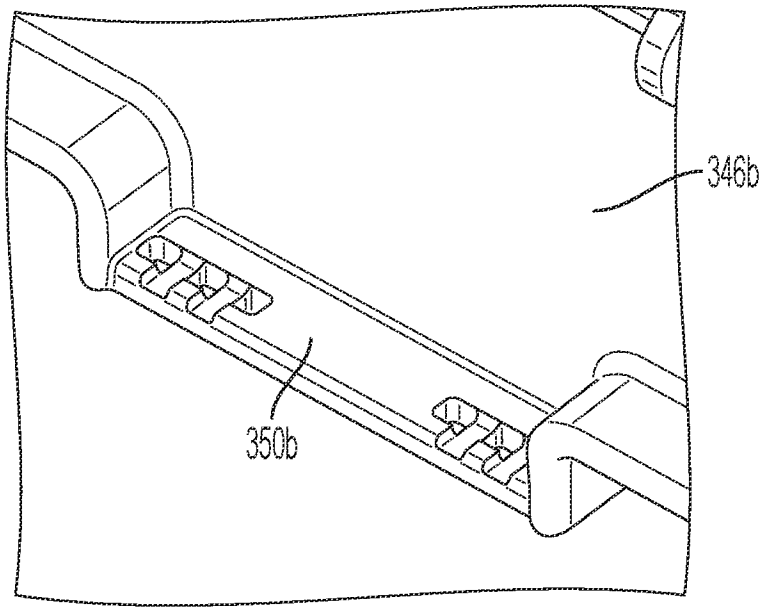
FIG. 23C is a detailed perspective view of a step of a container.
Figure 23B:
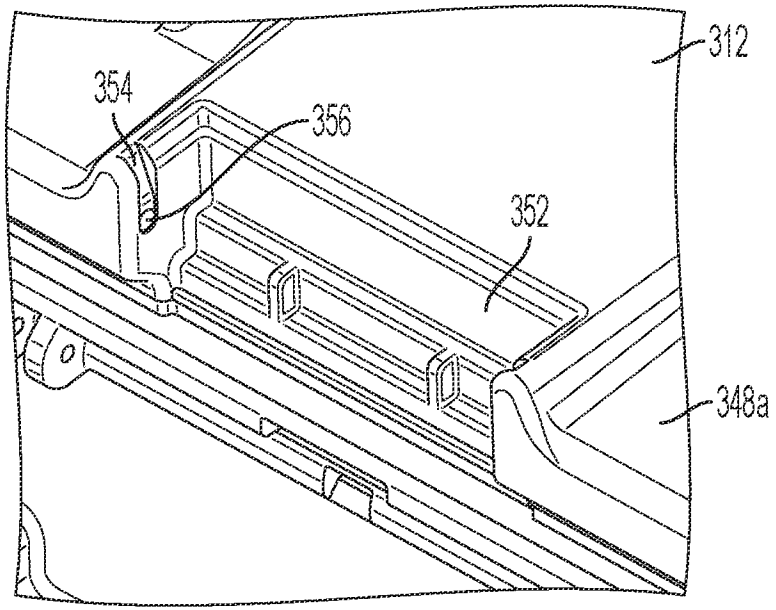
FIG. 23B is a detailed view of the carveout wherein the latch of the fourth embodiment is positioned.

As shown in FIGS. 23A-C and similar to other embodiments, latch mechanism 310 can also be disposed in a carveout 352. Carveout 352 may include one or more slots 354 and holes 356. In particular, slots 354 are formed in each side wall of carveout 352 near the laterally outermost edges thereof and extend downwardly from the top. Holes 356 are formed at the base of slots 354 and are formed as either regions of deeper indentations than the remainder of slots 354 or extend entirely through lid 348. Slots 354 and holes 356 are configured to receive pins 334. More specifically, slots 54 function as guides as latch mechanism 310 is positioned within carveout 52. Latch mechanism 310 is slid downwardly within carveout 352 with the laterally outward extending ends of pins 334 sliding in slots 54 until they reach holes 56. Pins 34 are slightly compressed inwardly while sliding in slots 54 and once latch mechanism 310 is pressed into a fully seated position, pins 334 are disposed in holes 56. When pins 334 are disposed within holes 56, the latch mechanism 310 is secured within carveout 52.

Those skilled in the art will recognize that the primary function of the latch mechanism 310 is to secure two bodies to one another. See FIG. 23A. In order to achieve this function, latch 314 is configured to selectively engage a step 50 such as that shown in FIG. 24C. More specifically, the primary hook 316 and the stopper 370 are configured to separately engage step 50 at different locations thereof. The operation of the latch mechanism 314 will be described below.

INDUSTRIAL APPLICABILITY

Turning now to FIGS. 12-15, the function of the latch mechanism 10 of the present invention positively coupling two bodies together will now be explained. FIG. 12 shows the latch mechanism 10 of the first embodiment coupling to containers together. For ease of reference, the top and bottom containers will be referred to using the identical reference numerals with the exception that the top container will include an "a", while the bottom container will include a "b".

Figure 13:
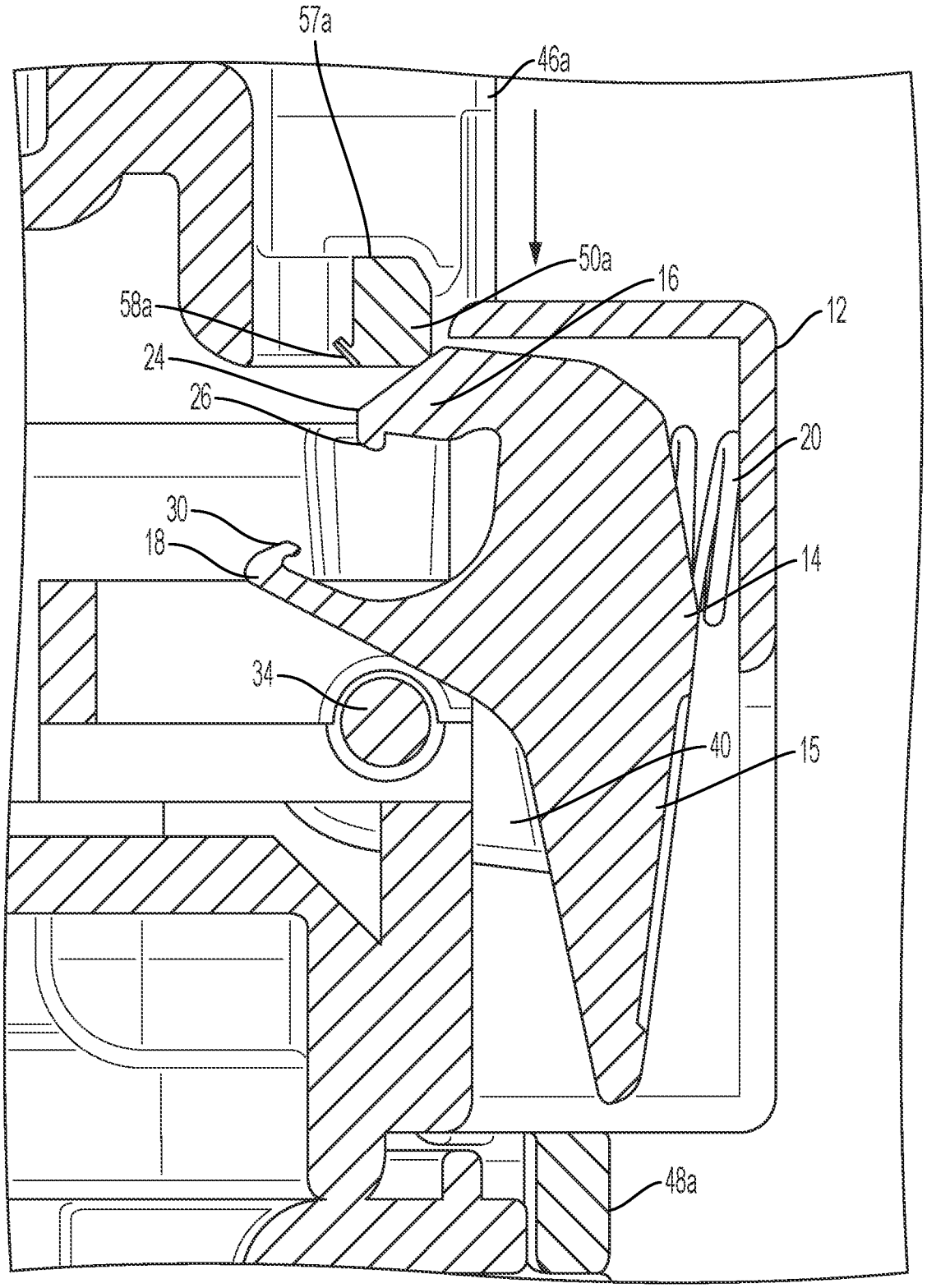
FIG. 13 is a cross sectional view of a latch receiving a step of a container.

Those skilled in the art will recognize that with the latch mechanism 10 of the first embodiment, body 46*a* will be coupled to lid 48*b*. As seen in FIG. 13, the first step is to position body 46*a* above lid 48*b*. Body 46*a* should be positioned such that step 50*a* is above the primary hook 16, and more specifically, above the step receiving surface 24. When properly positioned, body 46*a* can be pressed downward so that step 50*a* engages the step receiving surface 24. The application of downward force may also be achieved under the natural weight of body 46*a*. Step receiving surface 24 is angled so that when step 50*a* applies force thereto, latch 14 rotates against bias 20 toward its second position. Eventually, latch 14 rotates into its second position wherein the primary hook 16 is substantially obscured by the housing 12. When this occurs, latch 14 is displaced such that step 50*a* can move beneath the primary hook 16.

Figure 8:
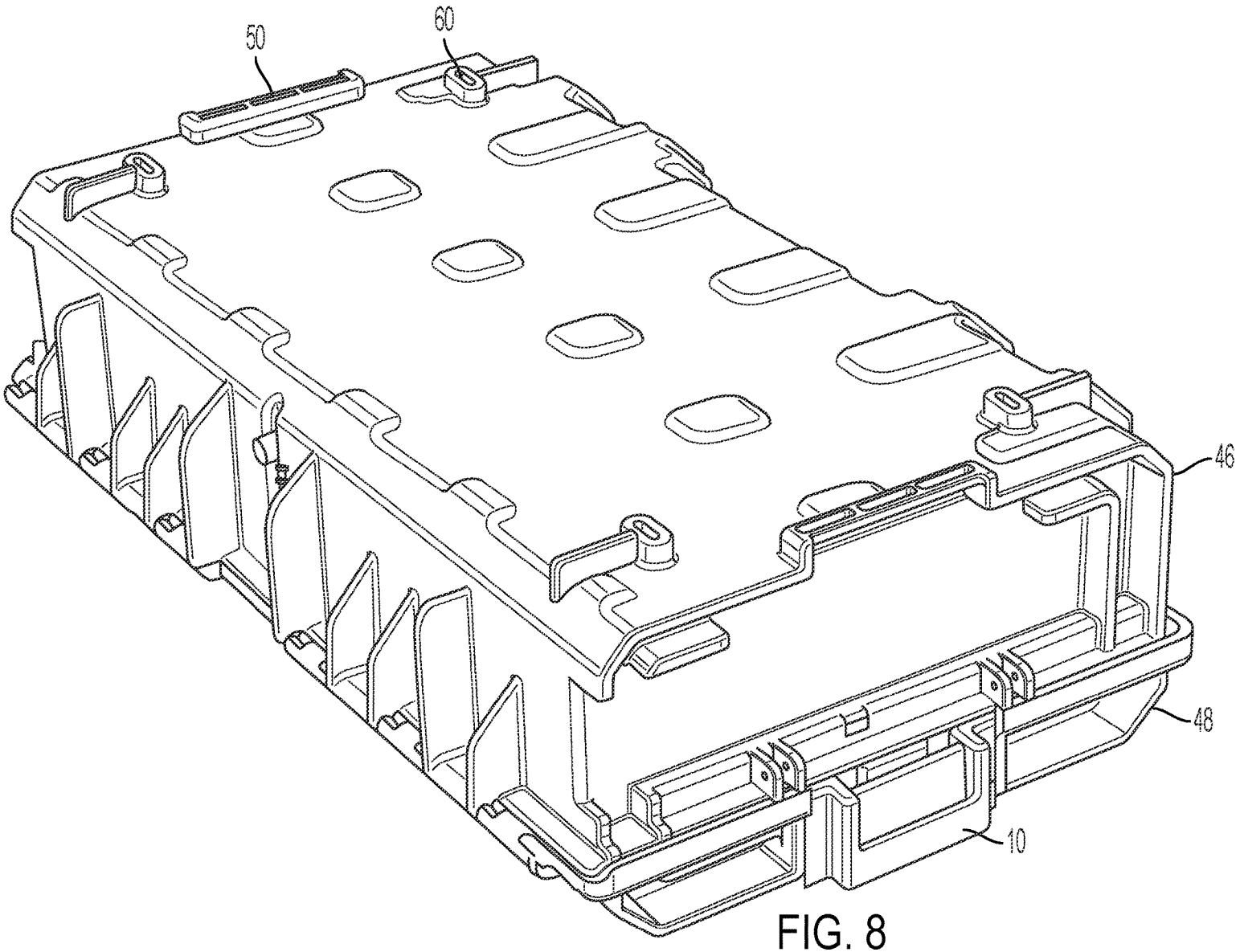
FIG. 8 is a bottom perspective view of a container employing a latch mechanism according to the first embodiment of the invention.
Figure 14:
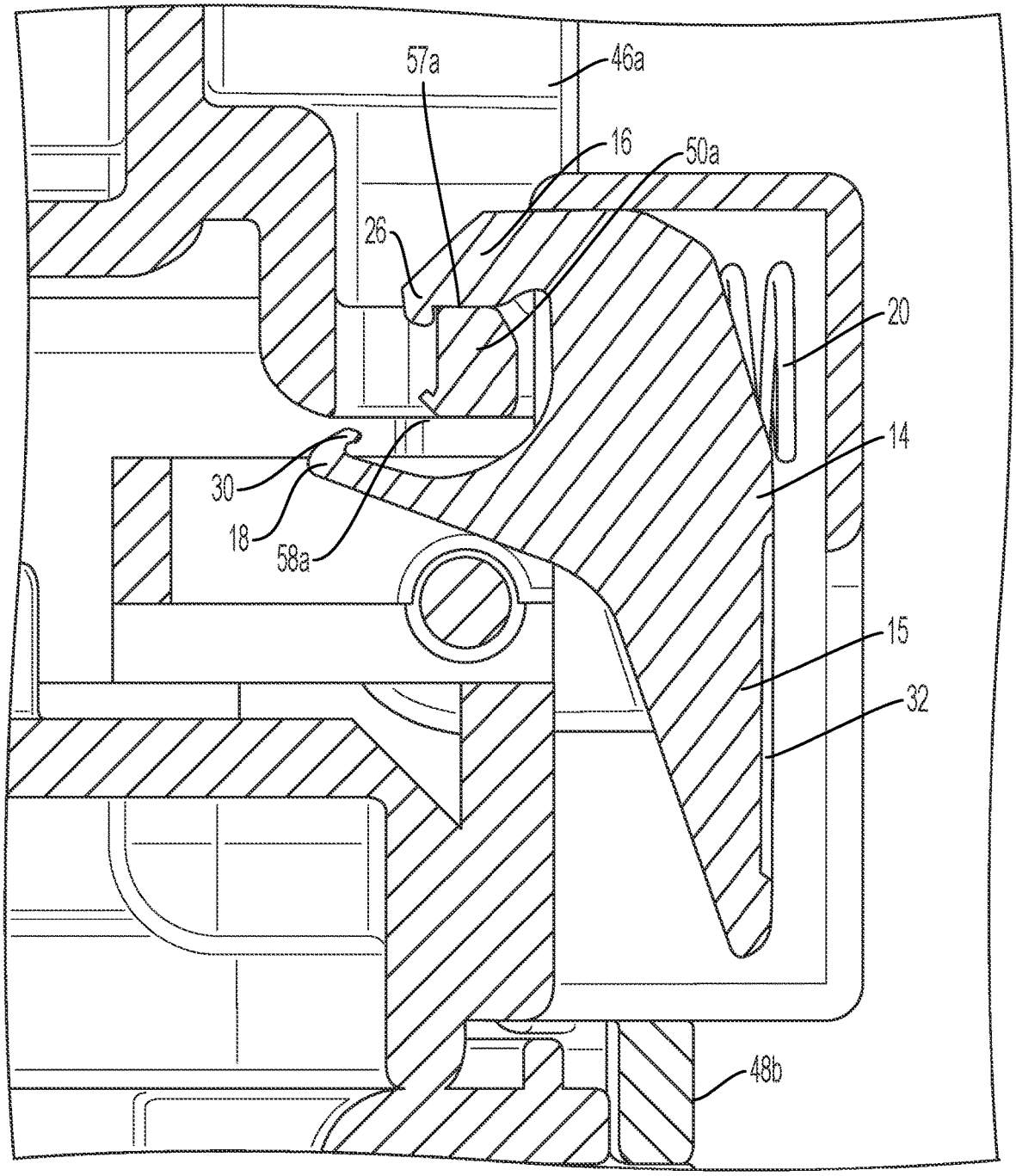
FIG. 14 is a cross sectional view of a latch in its first position.

As shown in FIG. 14, when step 50*a* is beneath primary hook 16, bias 20 automatically rotates latch 14 back to its first position. Primary hook 16 extends over upper portion 57*a* of step 50*a* with primary tooth 26 extending laterally inward of step 50*a* and generally into the middle rectangular opening. Any upward motion of body 46*a* will cause the primary hook 16 to engage the top surface of step 50*a* and therefore upward motion is precluded. And any inward lateral movement of body 46*a* relative to lid 48*b* is precluded by the engagement of primary tooth 26 on the side wall of upper portion 57*a* of step 50*a*. At this point, body 46*a* and lid 48*b* are positively coupled together by latch mechanism 10. (See FIG. 12.) Those skilled in the art will recognize that horizontal movement of body 46*a* will not free it from the latch mechanism 10 as such horizontal movement is limited by the primary tooth 26. Moreover, a second latch mechanism positioned on the other side of lid 48*b* may further limit horizontal movement of body 46*a*. Still further, as shown in FIG. 8, body 46 may include one or more feet 60. Feet 60 may be configured to be disposed into corresponding depressions 62, which may be found in lid 48.

Figure 15:
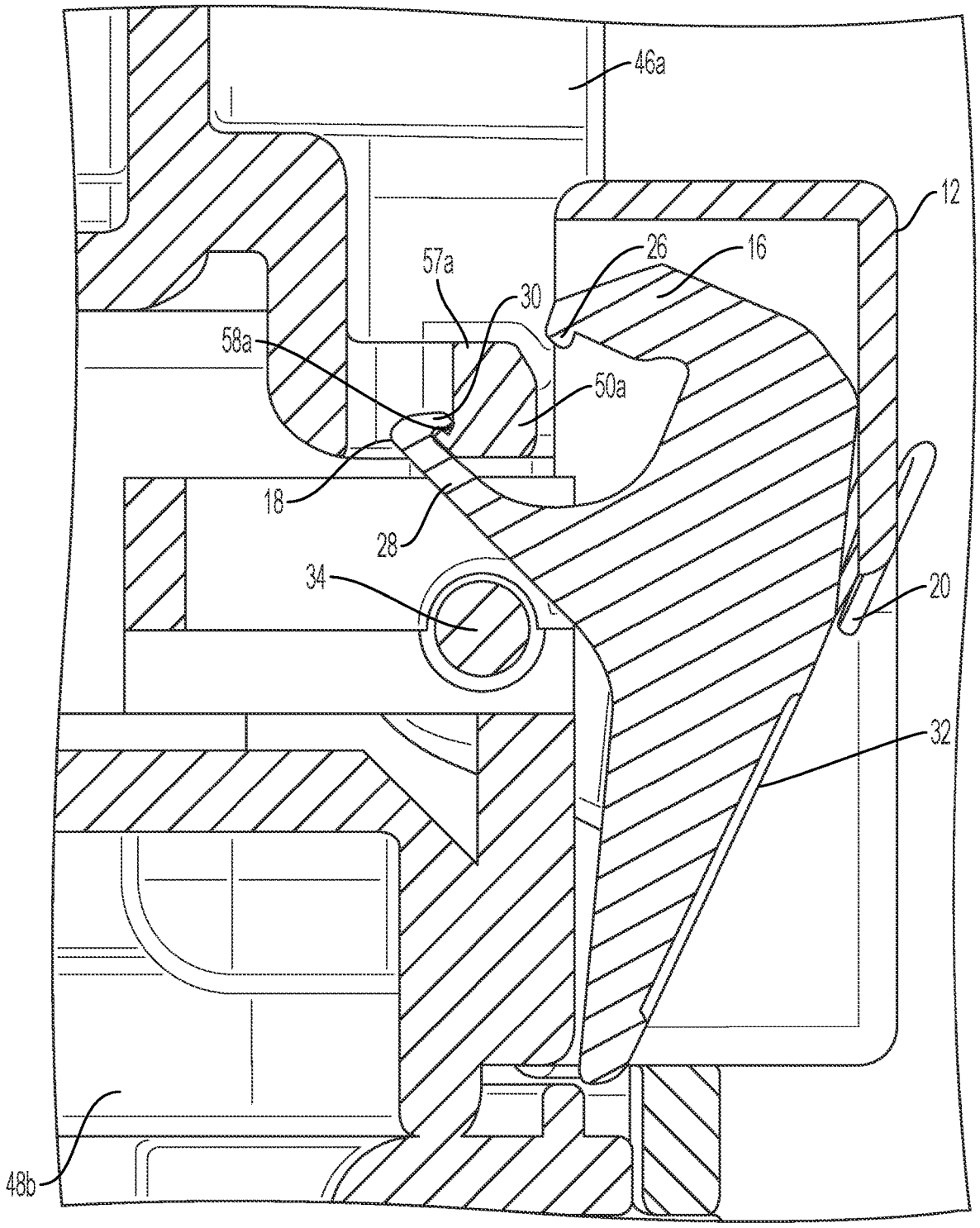
FIG. 15 is a cross sectional view of a latch in its second position.

When an operator wishes to release body 46*a* from lid 48*b*, she will apply pressure to the operator surface 32. In so doing, latch 14 is once again rotated against bias 20 into its second position. As step 50*a* is still positioned beneath primary hook 16, rotating latch 14 to its second position causes the secondary hook 18 to engage step 50*a*. More specifically, the secondary tooth 30 engages the lip 58*a* of step 50*a*. As seen in FIG. 15, the engagement of secondary tooth 30 to lip 58*a* is sufficient to positively hold latch 14 in its second position. However, since the length of secondary tooth 30 is small as compared to the overall length of step 50, the engagement of tooth 30 and lip 58*a* is insufficient to secure body 46*a* on lid 48*b*. Therefore, an operator may move body 46*a* upward to free it from lid 48*b*. In order to improve the ease in which the secondary tooth 30 may be disengaged from the lip 58*a*, the secondary hook 18 and/or the lip 58*a* may be flexible.

Those skilled in the art will recognize that the latch mechanisms of the second embodiment 110 and third embodiment 210 engage and disengage from a step 50 in the same way as that outlined for the first embodiment 10.

Figure 24C:
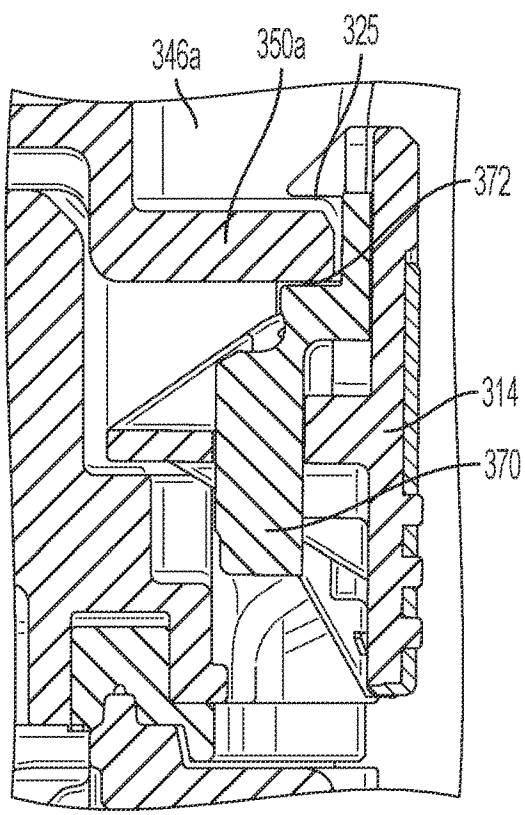
FIGS. 24A-C depict the progression of a latch of the fourth embodiment engaging a second container.
Figure 24B:
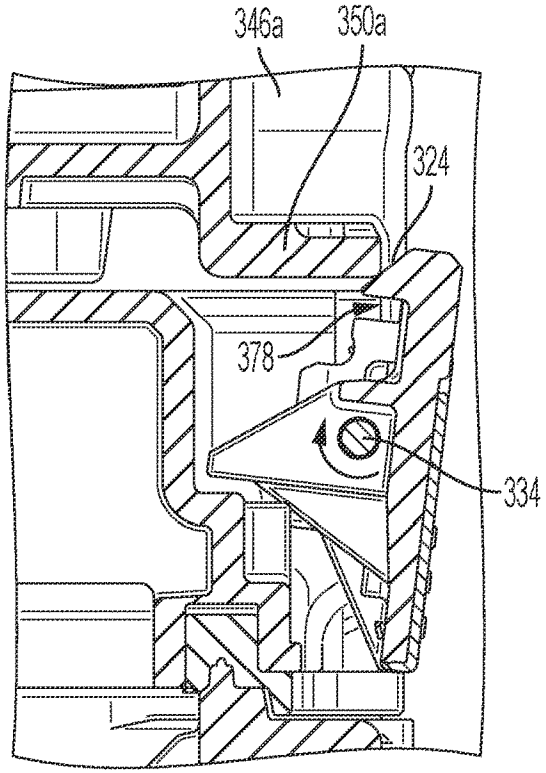
Figure 24A:
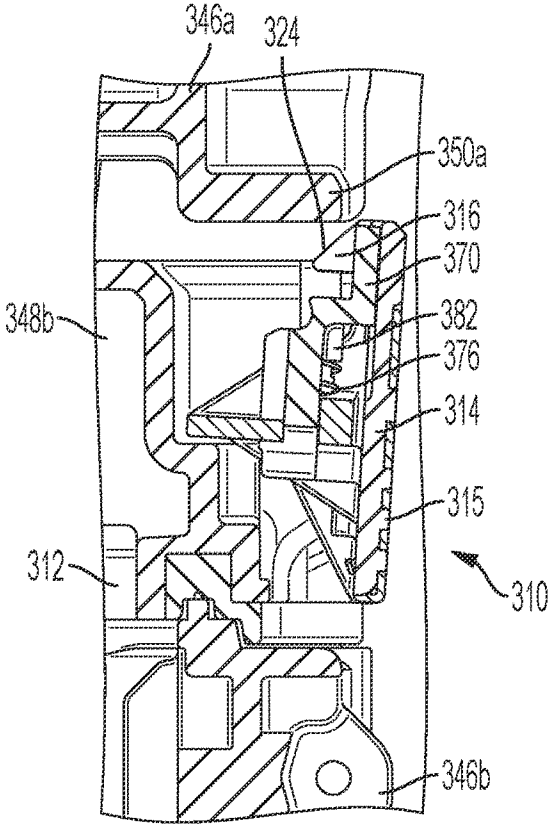

Turning now to FIG. 24A-24C, the fourth embodiment of the latch mechanism 310, also positively couples stackable containers together. As seen in FIG. 24A, the first step is to position body 346*a* above lid 346*b*. Body 346*a* should be positioned such that step 350*a* is above the primary hook 316, and more specifically, above the step receiving surface 324. When properly positioned, body 346*a* can be pressed downward so that step 350*a* engages the step receiving surface 324. The application of downward force may also be achieved under the natural weight of body 346*a*. Step receiving surface 324 is angled so that when step 350*a* applies force thereto, latch 314 rotates against bias 320 toward its second position. See FIG. 24B. Eventually, latch 14 rotates into its second position wherein the primary hook 316 is distal from the housing 312. As shown in FIG. 24C latch 314 is displaced such that step 350*a* can move beneath the primary hook 316. In this position, step 350*a* may also engage the locking surface 372 and cause the stopper 370 to move away from its upper position. As step 350*a* moves into the negative space 378, bias 320 causes the latch 314 to rotate back toward its first position. This is the locked position, wherein axial movement of the upper container 346*a* is limited. Upper container 346*a* is thus secured to the lid 348*b* of the lower container 346*b*.

Figure 25B:
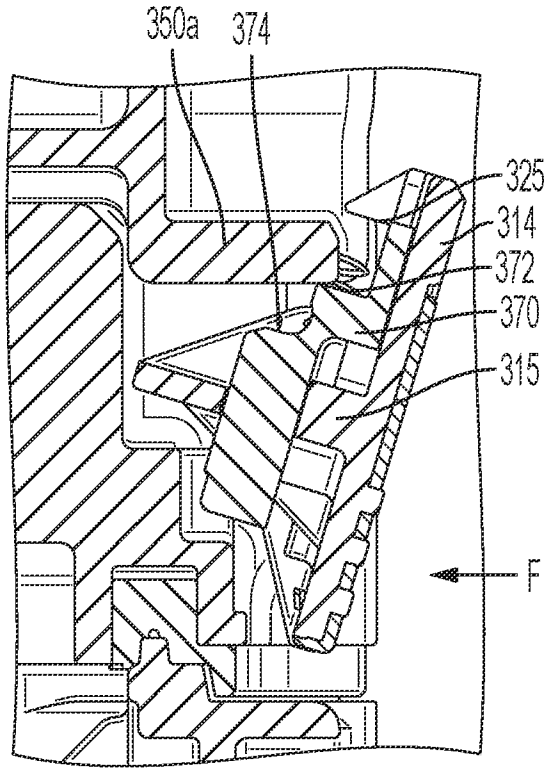
FIGS. 25A-D depict the progression of a latch of the fourth embodiment disengaging from a second container.
Figure 25A:
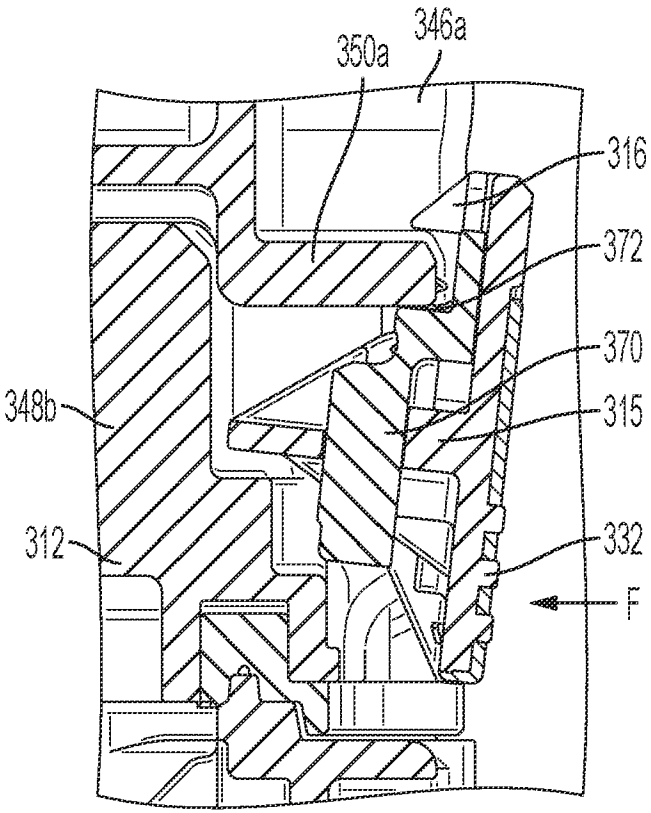
Figure 25D:
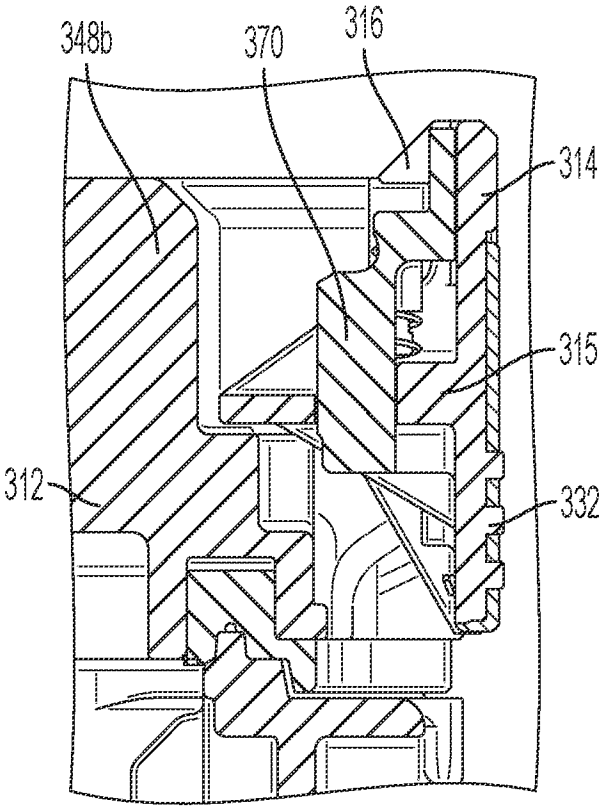
Figure 25C:
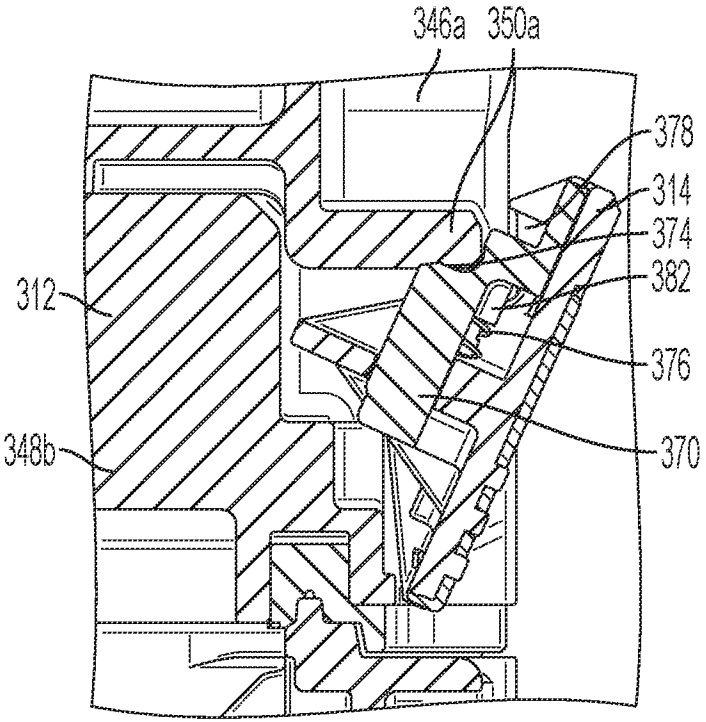

When an operator desires to remove the upper container, she follows the steps shown in FIGS. 25A-D. The first step is to apply force to the operator surface 332. Applying force here causes the latch 314 to rotate away from its first position toward its second position as shown in FIG. 25A. As shown in FIG. 25B, further rotation of latch 314 first moves the cantilevered surface 325 out of engagement with step 350*a*. Further rotation of latch 314 toward its second position, also eventually moves the locking surface 372 out of engagement with step 350*a*. When this occurs, the stopper bias 376 moves holder 370 back toward its upper position. The biased movement of the holder 370 causes the holding surface 374 to come into contact with the step 350*a*. In this position, as can be seen in FIG. 25C, the stopper holds the latch 314 in its second position. In this second position, the primary hook 316 is distal from the housing 312 (or lid 348*b*) and unable to secure step 350*a* of the upper container 346*a*. From her an operator may lift the upper container 346*a* and fully disengage it from the lid 348*b* of the lower container. Removal of the upper container 346*a* also removes the step 350*a* from engagement with the stopping surface 374. Once this occurs, the latch bias 320 causes the entire latch 314 to rotate back to its first position, wherein the primary hook 316 is adjacent the housing 312 (or lid 348*b*) as shown in FIG. 25D. Simultaneous with the rotation of the latch 314 back toward its first position, the stopper bias 376 may also move the stopper to its apex upper position. In this position, the negative space 378 created between the cantilevered surface 325 and the locking surface 372 may be smaller than the thickness of the step 350*a*. This prevents the step 350*a* from inadvertently engaging locking as the latch is rotated back to its first position. Thus, the operator may freely remove the upper container 346*a* without being hindered by the latch mechanism 310.

While the present invention has been described in connection with what is considered the most practical and preferred embodiments, it is understood that this invention is not limited to the disclosed embodiments but is intended to cover various arrangement included within the spirit and scope of the broadest interpretation of the attached claims so as to encompass all such modifications and equivalent arrangements.

The invention claimed is:

1. A latch mechanism comprising:

a housing;

a latch partially disposed within the housing and including a main body and a primary hook configured to secure a container to the housing, and wherein said latch is rotatably engaged to the housing and movable between a first position and a second position, wherein in said first position, the primary hook is adjacent the housing and in a position wherein it can secure a container to the housing, and wherein in said second position, the primary hook is distal from the housing and in a position wherein it cannot secure a container to the housing;

a latch bias configured to bias the latch toward its first position;

a stopper slidably engaged to the latch and including a locking surface and holding surface, said stopper movable between an upper position and a lower position; and a stopper bias configured to bias the stopper toward its upper position such that when the latch is in its first position, the locking surface and primary hook create a negative space configured to receive and secure the container to the housing; and when the latch is its second position, the holding surface is configured to engage the container and prevent the latch from rotating back to its first position.

2. The latch mechanism recited in claim 1, wherein the primary hook is configured to engage a step of the container when the latch is in its first position; and wherein the holding surface is configured to engage a step of the container when the latch is in its first position and the stopper is in its upper position.

3. The latch mechanism recited in claim 1, wherein the primary hook includes a step receiving surface configured to engage a step of the container and cause the latch to rotate from its from its first position toward its second position.

4. The latch mechanism recited in claim 3, wherein the step receiving surface is beveled.

5. The latch mechanism recited in claim 1, wherein the locking surface and the holding surface are steps and the locking surface is positioned above the holding surface.

6. The latch mechanism recited in claim 1, wherein the main body includes an operator surface configured to receive force from an operator and transfer said force into rotative movement wherein the latch rotates from its first position to its second position.

7. The latch mechanism recited in claim 1, wherein the main body is rotatably secured to the housing via pins.

8. A container comprising:

a plurality of walls defining an interior space;

a latch mechanism, said latch mechanism further comprising:

a housing;

a latch partially disposed within the housing and including a main body and a primary hook configured to secure a second container to the housing, and wherein said latch is rotatably engaged to the housing and movable between a first position and a second position, wherein in said first position, the primary hook is adjacent the housing and in a position wherein it can secure a second container to the housing, and wherein in said second position, the primary hook is distal from the housing and in a position wherein it cannot secure a second container to the housing;

a latch bias configured to bias the latch toward its first position;

a stopper slidably engaged to the latch and including a locking surface and a holding surface, and wherein said stopper is movable between an upper position and a lower position; and a stopper bias configured to bias the stopper toward its upper position such that when the latch is in its first position, the locking surface and primary hook create a negative space configured to receive and secure a second container to the housing, and wherein when the latch is its second position, the holding surface is configured to engage a second container and prevent the latch from rotating back to its first position.

9. The container recited in claim 8 further comprising a step configured to engage the latch mechanism of a second container when the container is stacked on top of the second container.

10. The container recited in claim 8, wherein the primary hook is configured to engage a step of a second container when the latch is in its first position; and wherein the holding surface is configured to engage a step of a second container when the latch is in its first position and the stopper is in its upper position.

11. The container recited in claim 8, wherein the primary hook includes a step receiving surface configured to engage a step of a second container and cause the latch to rotate from its first position toward its second position.

12. The container recited in claim 8, wherein the locking surface and the holding surface are steps and the locking surface is positioned above the holding surface.

13. A container system including at least a first container and a second container, said first container stackable on said second container, each said container further comprising:

a step formed on each container;

a latch disposed on each container, said latch having a hook and rotatably engaged to the container so as to be movable between a first latch position in which the hook is in a relatively inward location such that when said first container is stacked on said second container the hook of the second container overlies the step of the first container to secure said first container to said second container and a second latch position in which the hook is in a relatively outward location such that when said first container is stacked on said second container the hook of the second container does not overlie the step of said first container and does not secure said first container to said second container;

a latch bias configured to bias said latch towards said first latch position; and a stopper slidably disposed on said latch; wherein, when said latch is its second latch position, said stopper engages the step of the first container and prevents said latch from rotating to said first position.

14. The container system recited in claim 13, said stopper including a locking surface and a holding surface, said stopper slidable between a first stopper position and a second stopper position, each said container further comprising a stopper bias configured to bias the stopper toward its first stopper position, wherein when the latch is in its first latch position and the stopper is in its second stopper position the locking surface and hook create a negative space configured to receive and engage the step to secure said first container to said second container; and when the latch is moved to its second latch position, the stopper moves to the first stopper position and the holding surface is configured to engage the step of the first container and prevent the latch from rotating back to its first latch position.

15. The container system recited in claim 14, said first stopper position being an upper position and the second stopper position being a lower position.

16. The container system recited in claim 15, at least one of said first container and said second container comprising a container body having a plurality of walls and defining an interior space and a lid configured to selectively enclose the interior space, said latch disposed on said lid of said at least one of said first container and said second container.

17. The container system recited in claim 13, at least one of said first container and said second container comprising a container body having a plurality of walls and defining an interior space and a lid configured to selectively enclose the interior space, said latch disposed on said lid of said at least one of said first container and said second container.

18. The container system recited in claim 13, said latch bias comprising a spring.

19. The latch mechanism recited in claim 1, said latch bias comprising a spring, and said stopper bias comprising a spring.

20. The container recited in claim 8, said latch bias comprising a spring and said stopper bias comprising a spring.

* * * * *